US005998116A

United States Patent [19]

Hayoz et al.

[11] Patent Number: 5,998,116

[45] Date of Patent: Dec. 7, 1999

[54] COLOR-PHOTOGRAPHIC RECORDING MATERIAL

[75] Inventors: Pascal Hayoz, Marly; Christophe Bulliard, Fribourg; David George Leppard, Marly, all of Switzerland

[73] Assignee: Ciba Specialty Chemicals Corporation, Tarrytown, N.Y.

[21] Appl. No.: 08/925,017

[22] Filed: Sep. 8, 1997

[30] Foreign Application Priority Data

Sep. 13, 1996 [CH] Switzerland ..... 2252/96

[51] Int. Cl.[6] ..... G03C 1/815

[52] U.S. Cl. ..... 430/507; 430/512; 430/551; 430/931

[58] Field of Search ..... 430/512, 931, 430/551, 507

[56] References Cited

U.S. PATENT DOCUMENTS

| | | | |
|---|---|---|---|
| 3,242,175 | 3/1966 | Duennenberger et al. | 260/248 |
| 3,244,708 | 4/1966 | Duennenberger et al. | 260/248 |
| 3,444,164 | 5/1969 | Luthi et al. | 260/248 |
| 4,619,956 | 10/1986 | Susi | 524/87 |
| 5,300,414 | 4/1994 | Leppard et al. | 430/507 |
| 5,364,749 | 11/1994 | Leppard et al. | 430/507 |
| 5,462,846 | 10/1995 | Yoneyama | 430/507 |
| 5,489,503 | 2/1996 | Toan | 430/507 |
| 5,538,840 | 7/1996 | Van Toan et al. | 430/52 |
| 5,597,854 | 1/1997 | Birbaum et al. | 430/512 |
| 5,674,668 | 10/1997 | Hagemann et al. | 430/512 |

FOREIGN PATENT DOCUMENTS

| | | |
|---|---|---|
| 0530135 | 3/1993 | European Pat. Off. . |
| 2084822 | 12/1971 | France . |
| 4444258 | 11/1995 | Germany . |
| 1321561 | 6/1973 | United Kingdom . |
| 2286774 | 8/1995 | United Kingdom . |
| 2294043 | 4/1996 | United Kingdom . |
| 2297091 | 7/1996 | United Kingdom . |
| 9628431 | 9/1996 | WIPO . |

OTHER PUBLICATIONS

Chem. Abst. 124:189367t, Abstract of DE 4,444258, Nov. 1995.

Chem. Abst. 119: 213920n Abstract of EP 530,135 Mar. 1993.

*Primary Examiner*—Richard L. Schilling

*Attorney, Agent, or Firm*—Luther A. R. Hall; Kevin T. Mansfield

[57] ABSTRACT

The invention relates to a color-photographic recording material comprising, on a support, a blue-sensitive, a green-sensitive and/or a red-sensitive silver-halide emulsion layer, a protection layer above the sensitive layers, and, if desired, separation layers between the sensitive layers, where at least one of said layers includes a UV absorber of the formula (1)

or (1a)

The stabilizers of the formula (1) or (1*a*) have good inherent stability and high light absorption; the photographic recording material described has excellent stability of the magenta, cyan and yellow layers.

14 Claims, No Drawings

COLOR-PHOTOGRAPHIC RECORDING MATERIAL

The present invention relates to a novel colour-photographic recording material which includes a UV absorber of the 2-biphenyl-4-aryl-6-(2-hydroxyphenyl)-1,3,5-triazine type.

Individual compounds of this type have been described as stabilizers for plastics or sun screens in U.S. Pat. Nos. 3,242,175, 3,244,708, 3,444,164, GB-A-2 286 774, GB-A-2 297 091 and WO-96/28 431; GB-A-1 321 561 and WO-96/28 431 also mention photographic material.

Photographic recording material is typically based on silver-halide emulsions, silver-halide and, in the case of colour-photographic material, also the dyes or dye precursors being sensitive to UV radiation. UV radiation having a wavelength of from 300 to 400 nm, in particular, changes or bleaches the material. The changes caused by the UV radiation are undesired; a UV absorber is therefore usually added to one of the upper layers of the photographic recording material.

However, the known UV absorbers frequently have undesired properties, for example inadequate inherent stability to light, heat or moisture, migration or volatility, difficult emulsification, formation of crystals, or agglomeration. It is known to use certain UV absorbers of the hydroxyphenyltriazine type in photographic materials. The publications EP-A-530 135, U.S. Pat. Nos. 5,364,749, 5, 300,414, 5,489,503, 5,538,840, GB-A-2 294 043, DE-A-4 444 258 and U.S. Pat. No. 5,462,846 describe, for example, photographic materials which include, as UV absorber, a compound of the 2,4-diaryl-6-(2-hydroxyphenyl)-1,3,5-triazine type.

A group of triazine UV absorbers has now been found which, surprisingly, satisfies the demands made by industry to a large extent. In particular, this group of compounds is suitable for increasing the stability of the magenta, cyan and yellow layers of photographic materials.

The novel UV absorbers can be used for photosensitive materials of all types. For example, they can be used for colour paper, colour reversal paper, direct-positive colour material, colour negative film, colour positive film, colour reversal film and others. They are preferably used, inter alia, for photosensitive colour material which includes a reversal substrate or forms positives.

Furthermore, these triazines can advantageously be combined with UV absorbers of the hydroxyphenylbenzotriazole type, in particular representatives thereof which are liquid at room temperature (cf. for example, U.S. Pat. No. 4,853,471, 4,973,702, 4,921,966 and 4,973,701), and/or with 2-hydroxyphenyl-triazines from other classes, as described, for example, in the publications mentioned at the outset and in U.S. Pat. No. 5,488,108 and U.S. Pat. No. 4,826,978.

The present application thus relates to colour-photographic recording material comprising, on a base, at least one blue-sensitive silver-halide emulsion layer, at least one green-sensitive silver-halide emulsion layer and/or at least one red-sensitive silver-halide emulsion layer, a protection layer above the sensitive layers, and, if desired, layers between the sensitive layers, where at least one of said layers includes a UV absorber of the formula (1)

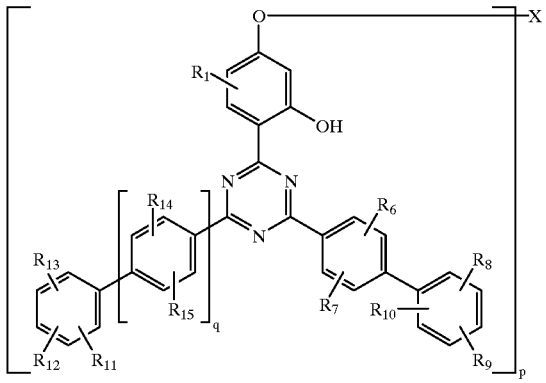

or (1a)

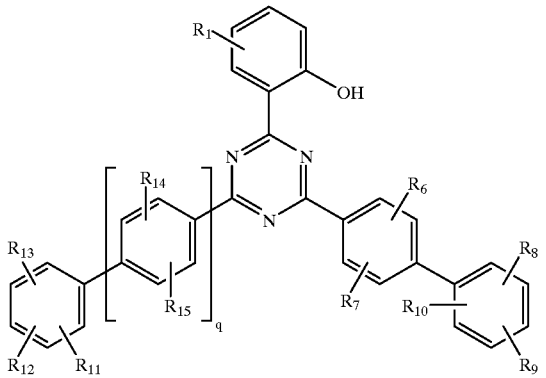

in which $R_1$ is hydrogen; $C_1$–$C_{24}$alkyl or $C_5$–$C_{12}$cycloalkyl; or $C_1$–$C_{24}$alkyl or $C_5$–$C_{12}$cycloalkyl which is substituted by 1 to 9 halogen atoms, —$R_4$, —$OR_5$, —$N(R_5)_2$, =$NR_5$, =O, —$CON(R_5)_2$, —$COR_5$, —$COOR_5$, —$OCOR_5$, —$OCON(R_5)_2$, —CN, —$NO_2$, —$SR_5$, —$SOR_5$, —$SO_2R_5$, —$P(O)(OR_5)_2$, a morpholinyl, piperidinyl, 2,2,6,6-tetramethylpiperidinyl, piperazinyl or N-methylpiperazinyl group, or a combination thereof; or $C_1$–$C_{24}$alkyl or $C_5$–$C_{12}$cycloalkyl which is interrupted by 1 to 6 phenylene, —O—, —$NR_5$—, —$CONR_5$—, —COO—, —OCO—, —$CH(R_5)$—, —$C(R_5)_2$— or —CO— groups, or a combination thereof; or $R_1$ is $C_2$–$C_{24}$alkenyl; halogen; —$SR_3$, $SOR_3$; $SO_2R_3$; —$SO_3H$; or $SO_3M$;

$R_3$ is $C_1$–$C_{20}$alkyl; $C_3$–$C_{18}$alkenyl; $C_5$–$C_{12}$cycloalkyl; $C_7$–$C_{15}$phenylalkyl, or $C_6$–$C_{12}$aryl which is unsubstituted or substituted by 1 to 3 $C_1$–$C_4$alkyl groups;

$R_4$ is unsubstituted $C_6$–$C_{12}$aryl; $C_6$–$C_{12}$aryl which is substituted by 1 to 3 halogen atoms, $C_1$–$C_8$alkyl or $C_1$–$C_8$alkoxy, or a combination thereof; $C_5$–$C_{12}$cycloalkyl; unsubstituted $C_7$–$C_{15}$phenylalkyl; $C_7$–$C_{15}$phenylalkyl which is substituted on the phenyl ring by 1 to 3 halogen atoms, $C_1$–$C_8$alkyl or $C_1$–$C_8$alkoxy, or a combination thereof; or $C_2$–$C_8$alkenyl;

$R_5$ is $R_4$; hydrogen; $C_1$–$C_{24}$alkyl; or a radical of the formula

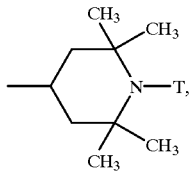

in which

T is hydrogen; $C_1$–$C_8$alkyl; $C_2$–$C_8$alkyl which is substituted by one or more hydroxyl groups or by one or more acyloxy groups; oxygen; hydroxyl; —$CH_2CN$; $C_1$–$C_{18}$alkoxy; $C_5$–$C_{12}$cycloalkoxy; $C_3$–$C_6$alkenyl; $C_7$–$C_9$phenylalkyl; $C_7$–$C_9$phenylalkyl which is monosubstituted, disubstituted or trisubstituted on the phenyl ring by $C_1$–$C_4$alkyl; or aliphatic $C_1$–$C_8$alkanoyl;

$R_6$ to $R_{15}$, independently of one another, are hydrogen; hydroxyl; —CO≡N; $C_1$–$C_{20}$alkyl; $C_1$–$C_{20}$alkoxy; $C_7$–$C_{20}$phenylalkyl; $C_4$–$C_{12}$cycloalkyl; $C_4$–$C_{12}$cycloalkoxy; halogen; halo-$C_1$–$C_5$alkyl; sulfonyl; carboxyl; acylamino; acyloxy; $C_1$–$C_{12}$alkoxycarbonyl; aminocarbonyl; —O—Y; or O—Z; or $R_8$ and $R_9$, together with the phenyl radical, form a cyclic radical which is interrupted by one or more oxygen or nitrogen atoms; and $R_{11}$, in the case where q is 0, may additionally be —$NG_{16}G_{17}$, where $G_{16}$ is hydrogen or $C_1$–$C_{20}$alkyl; $G_{17}$ is hydrogen, $C_1$–$C_{20}$alkyl, $C_7$–$C_{13}$phenylalkyl, —C(=O)—$G_{19}$, —C(=O)—NH—$G_{16}$; and $G_{19}$ is $C_1$–$C_{20}$alkyl; $C_2$–$C_{20}$alkyl which is interrupted by 1 to 6 oxygen atoms and/or is substituted by OH, halogen, $NH_2$, $NHG_9$ or $NG_9G_{10}$; $C_1$–$C_{20}$alkoxy; phenyl; $C_7$–$C_{13}$phenylalkyl or $C_2$–$C_{20}$alkenyl; where $G_9$ and $G_{10}$ are as $R_5$ defined above;

M is an alkali metal;

p is 1 or 2; q is 0 or 1;

and, in the case where p=1,

X, Y and Z, independently of one another, are $R_y$; $R_x$-substituted $C_1$–$C_{24}$alkyl; $C_2$–$C_{50}$alkyl which is interrupted by one or more oxygen atoms and substituted by one or more of the groups OH and/or $R_x$; $R_x$-substituted $C_4$–$C_{12}$cycloalkyl; $R_yO$-substituted $C_4$–$C_{12}$cycloalkyl; $C_4$–$C_{20}$alkenyl which is interrupted by one or more oxygen atoms; or a radical of the formula —CH(($CH_2)_n$—$R_2$)—CO—O—$(CH_2)_m$—$R'_2$; —CH(($CH_2)_n$—$R_2$)—CO—(NR')—$(CH_2)_m$—$R'_2$;

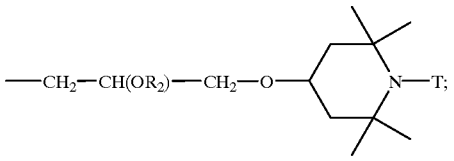

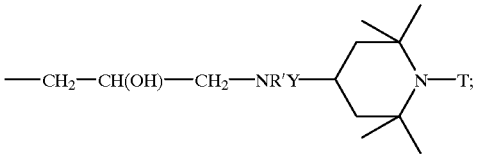

-continued

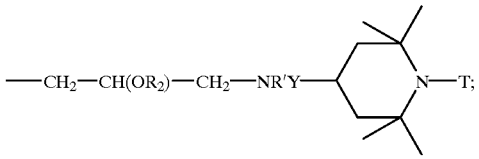

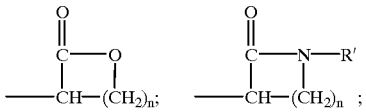

—CO—$(CH_2)_n$—$R_2$; —CO—O—$(CH_2)_n$—$R_2$; —$CH_2$—CH(—O—(CO)—$R_2$)—$R'_2$; or —CO—NR'—$(CH_2)_n$—$R_2$;

$R_2$ and $R'_2$, independently of one another, are $R_x$ if bonded to a carbon atom or $R_y$ if bonded to an atom other than carbon;

n is from 0 to 20; and m is from 0 to 20; and, in the case where p=2,

Y and Z, independently of one another, are as defined for p=1; and

X is $C_2$–$C_{12}$alkylene; —CO—($C_2$—$C_{12}$alkylene)—CO—; —CO-phenylene-CO—; CO-biphenylene-CO—; CO—O—($C_2$–$C_{12}$alkylene)—O—CO—; —CO—O-phenylene-O—CO—; —CO—O-biphenylene-O—CO—; —CO—NR'—($C_2$–$C_{12}$alkylene)—NR'—CO—; —CO—NR'-phenylene-NR'—CO—; —CO—NR'-biphenylene-NR'—CO—; —$CH_2$—CH(OH)—$CH_2$—; —$CH_2$—CH($OR_2$)—$CH_2$—; —$CH_2$—CH(OH)—$CH_2$—O—D—O—$CH_2$—CH(OH)—$CH_2$; —CH(($CH_2)_nR_2$)—COO—D—OOC—CH(($CH_2)_nR_2$)—; or —$CH_2$—CH($OR_2$)—$CH_2$—O—D—O—$CH_2$—CH($OR_2$)—$CH_2$—;

D is $C_2$–$C_{12}$alkylene; $C_4$–$C_{50}$alkylene which is interrupted by one or more oxygen atoms; phenylene; biphenylene or phenylene-E-phenylene;

E is —O—; —S—; —$SO_2$—; —$CH_2$—; —CO—; or —$C(CH_3)_2$—;

$R_x$ is hydrogen; hydroxyl; $C_1$–$C_{20}$alkyl; $C_4$–$C_{12}$cycloalkyl; $C_1$–$C_{20}$alkoxy; $C_4$–$C_{12}$cycloalkoxy; $C_4$–$C_{12}$cycloalkyl or $C_4$–$C_{12}$cycloalkyloxy which is interrupted by one or more oxygen atoms; $C_6$–$C_{12}$aryl; hetero-$C_3$–$C_{12}$aryl; —$OR_z$; $NHR_z$; $R_z$; CONR'R"; allyl; $C_2$–$C_{20}$alkenyl; $C_4$–$C_{12}$cycloalkenyl; $C_4$–$C_{12}$cycloalkenyl which is interrupted by one or more oxygen atoms; $C_3$–$C_{20}$alkynyl; $C_6$–$C_{12}$cycloalkynyl; or $C_1$–$C_{20}$alkyl, $C_2$–$C_{20}$alkoxy or $C_4$–$C_{12}$cycloalkyl, which is substituted by hydroxyl, —$NH_2$, —NH—$C_1$–$C_8$alkyl, —NH-cyclohexyl, —N($C_1$–$C_8$alkyl)$_2$, dicyclohexylamino, halogen, $C_1$–$C_{20}$alkyl, $C_1$–$C_{20}$alkoxy, $C_4$–$C_{12}$cycloalkyl, $C_4$–$C_{12}$cycloalkoxy, $C_2$–$C_{20}$alkenyl, $C_4$–$C_{12}$cycloalkyl, $C_3$–$C_{20}$alkynyl, $C_6$–$C_{12}$cycloalkynyl, $C_6$–$C_{12}$aryl, acylamino, acyloxy, sulfonyl, carboxyl, (meth)acryloxy, (meth)acrylamino,

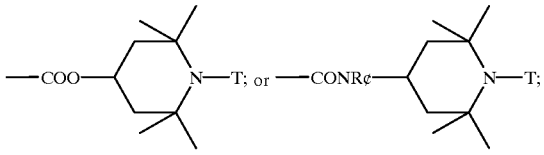

$R_y$ is hydrogen; $C_1$–$C_{20}$alkyl; $C_4$–$C_{12}$cycloalkyl; $C_4$–$C_{12}$cycloalkyl which is interrupted by one or more oxygen atoms; $C_6$–$C_{12}$aryl; hetero-$C_3$–$C_{12}$aryl; $R_z$; allyl; $C_2$–$C_{20}$alkenyl; $C_4$–$C_{12}$cycloalkenyl which is uninterrupted or interrupted by one or more oxygen atoms; $C_3$–$C_{20}$alkynyl; $C_6$–$C_{12}$cycloalkynyl; or $C_1$–$C_{20}$alkyl or $C_4$–$C_{12}$cycloalkyl which is substituted by hydroxyl, —$NH_2$, —NH—$C_1$–$C_8$alkyl, —NH-cyclohexyl, —N($C_1$–$C_8$alkyl)$_2$, dicyclohexylamino, halogen, $C_1$–$C_{20}$alkyl, $C_1$–$C_{20}$alkoxy, $C_4$–$C_{12}$cycloalkyl, $C_4$–$C_{12}$cycloalkoxy, $C_2$–$C_{20}$alkenyl, $C_4$–$C_{12}$cycloalkyl, $C_3$–$C_{20}$alkynyl, $C_6$–$C_{12}$cycloalkynyl, $C_6$–$C_{12}$aryl, acylamino, acyloxy, sulfonyl, carboxyl, (meth)acryloxy, (meth)acrylamino,

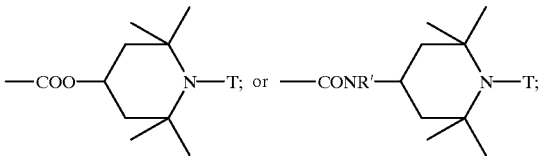

$R_z$ is —COR'; —COOR'; —CONR'R"; —CO—CH═$CH_2$; or —CO—C($CH_3$)═$CH_2$;

R' and R", independently of one another, are hydrogen; $C_1$–$C_{20}$alkyl; $C_4$–$C_{50}$alkyl which is interrupted by one or more oxygen atoms; $C_4$–$C_{12}$cycloalkyl; $C_4$–$C_{12}$cycloalkyl which is interrupted by one or more oxygen atoms; $C_2$–$C_{20}$alkenyl; $C_2$–$C_{20}$alkenyl which is interrupted by one or more oxygen atoms; $C_6$–$C_{12}$aryl; or $C_1$–$C_{20}$alkyl or $C_4$–$C_{12}$cycloalkyl which is substituted by hydroxyl, —$NH_2$, —NH—$C_1$–$C_8$alkyl, —NH-cyclohexyl, –N($C_1$–$C_8$alkyl)$_2$, dicyclohexylamino, halogen, $C_1$–$C_{20}$alkyl, $C_1$–$C_{20}$alkoxy, $C_4$–$C_{12}$cycloalkyl, $C_4$–$C_{12}$cycloalkoxy, $C_2$–$C_{20}$alkenyl, $C_4$–$C_{12}$cycloalkyl, $C_3$–$C_{20}$alkynyl, $C_6$–$C_{12}$cycloalkynyl, $C_6$–$C_{12}$aryl, acylamino, acyloxy, sulfonyl, carboxyl, (meth)acryloxy, (meth)acrylamino,

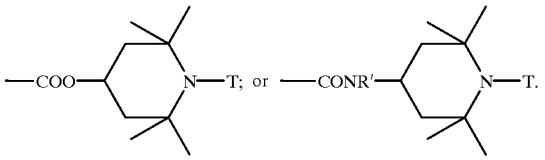

Of particular importance is a photographic recording material in which, in the stabilizer of the formula (1) or (1a), $R_1$ is hydrogen; $C_1$–$C_{24}$alkyl or $C_5$–$C_{12}$cycloalkyl; or $C_1$–$C_{24}$alkyl or $C_5$–$C_{12}$cycloalkyl which is substituted by 1 to 9 halogen atoms, —$R_4$, —$OR_5$, —N($R_5$)$_2$, ═$NR_5$, ═O, —CON($R_5$)$_2$, —$COR_5$, —$COOR_5$, —$OCOR_5$, —OCON($R_5$)$_2$, —CN, —$NO_2$, —$SR_5$,—$SOR_5$, —$SO_2R_5$, —P(O)($OR_5$)$_2$, a morpholinyl, piperidinyl, 2,2,6,6-tetramethylpiperidinyl, piperazinyl or N-methylpiperazinyl group, or a combination thereof; or $C_1$–$C_{24}$alkyl or $C_5$–$C_{12}$cycloalkyl which is interrupted by 1 to 6 phenylene, —O—, —$NR_5$—, —CON$R_5$—, —COO—, —OCO—, —CH($R_5$)—, —C($R_5$)$_2$— or —CO— groups, or a combination thereof; or $R_1$ is $C_2$–$C_{24}$alkenyl; halogen; —$SR_3$, $SOR_3$; $SO_2R_3$; —$SO_3H$; —$SO_3M$; or a radical of the formula

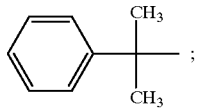

$R_3$ is $C_1$–$C_{20}$alkyl; $C_3$–$C_{18}$alkenyl; $C_5$–$C_{12}$cycloalkyl; $C_7$–$C_{15}$phenylalkyl, or $C_6$–$C_{12}$aryl which is unsubstituted or substituted by 1 to 3 $C_1$–$C_4$alkyl groups;

$R_4$ is unsubstituted $C_6$–$C_{12}$aryl; $C_6$–$C_{12}$aryl which is substituted by 1 to 3 halogen atoms, $C_1$–$C_8$alkyl or $C_1$–$C_8$alkoxy, or a combination thereof; $C_5$–$C_{12}$cycloalkyl; unsubstituted $C_7$–$C_{15}$phenylalkyl; $C_7$–$C_{15}$phenylalkyl which is substituted on the phenyl ring by 1 to 3 halogen atoms, $C_1$–$C_8$alkyl or $C_1$–$C_8$alkoxy, or a combination thereof; or $C_2$–$C_8$alkenyl;

$R_5$ is $R_4$; hydrogen; $C_1$–$C_{24}$alkyl; or a radical of the formula

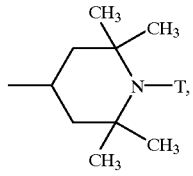

in which

T is hydrogen; $C_1$–$C_8$alkyl; $C_2$–$C_8$alkyl which is substituted by one or more hydroxyl groups or by one or more acyloxy groups; oxygen; hydroxyl; —$CH_2CN$; $C_1C_{18}$alkoxy; $C_5$–$C_{12}$cycloalkoxy; $C_3$–$C_6$alkenyl; $C_7$–$C_9$phenylalkyl; $C_7$–$C_9$phenylalkyl which is monosubstituted, disubstituted or trisubstituted on the phenyl ring by $C_1$–$C_4$alkyl; or aliphatic $C_1$–$C_8$alkanoyl;

$R_6$ to $R_{15}$, independently of one another, are hydrogen; hydroxyl; —C≡N; $C_1$–$C_{20}$alkyl; $C_1$–$C_{20}$alkoxy; $C_7$–$C_{20}$phenylalkyl; $C_4$–$C_{12}$cycloalkyl; $C_4$–$C_{12}$cycloalkoxy; halogen; halo-$C_1$–$C_5$alkyl; sulfonyl; carboxyl; acylamino; acyloxy; $C_1$–$C_{12}$alkoxycarbonyl; aminocarbonyl; —O—Y; or O—Z; or $R_8$ and $R_9$, together with the phenyl radical, form a cyclic radical which is interrupted by one or more oxygen or nitrogen atoms;

M is an alkali metal;

p is 1 or 2;

q is 0 or 1;

and, in the case where p=1, X, Y and Z, independently of one another, are hydrogen; $R_y$; $R_2$-substituted $C_1$–$C_{24}$alkyl; $C_2$–$C_{50}$alkyl which is interrupted by one or more oxygen atoms and substituted by one or more of the groups OH and/or $R_2$; $R_2$-substituted $C_4$–$C_{12}$cycloalkyl; $R_2O$-substituted $C_4$–$C_{12}$cycloalkyl; $C_4$–$C_{20}$alkenyl which is interrupted by one or more oxygen atoms; or a radical of the formula —CH(($CH_2$)$_n$—$R_2$)—CO—O—($CH_2$)$_m$—R'$_2$; —CH(($CH_2$)$_n$—$R_2$)—CO—(NR')—($CH_2$)$_m$—R'$_2$;

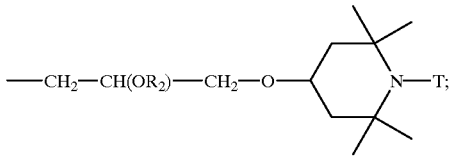

-continued

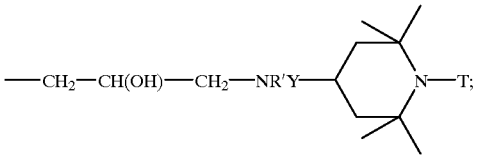

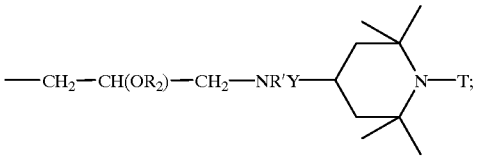

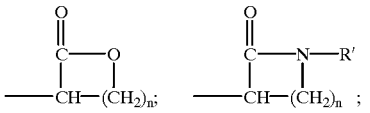

—CO—$(CH_2)_n$—$R_2$; —CO—O—$(CH_2)_n$—$R_2$; —$CH_2$—CH(—O—(CO)—$R_2$)—$R'_2$; or —CO—NR'—$(CH_2)_n$—$R_2$;

$R_2$ and $R'_2$, independently of one another, are $R_x$ if bonded to a carbon atom or $R_y$ if bonded to an atom other than carbon;

n is from 0 to 20; and m is from 0 to 20; and, in the case where p=2,

Y and Z, independently of one another, are as defined for p=1; and

X is $C_2$–$C_{12}$alkylene; —CO—($C_2$–$C_{12}$alkylene)-CO—; —CO-phenylene-CO—; CO-biphenylene-CO—; CO—O—($C_2$–$C_{12}$alkylene)-O—CO—; —CO—O-phenylene-O—CO—; —CO—O-biphenylene-O—CO—; —CO—NR'—($C_2$–$C_{12}$alkylene)-NR'—CO—; —CO—NR'-phenylene-NR'—CO—; —CO—NR'-biphenylene-NR'—CO—; —$CH_2$—CH(OH) —$CH_2$—; —$CH_2$—CH($OR_2$) —$CH_2$—; —$CH_2$—CH(OH)—$CH_2$—O—D—O—$CH_2$—CH(OH)—$CH_2$; or —$CH_2$—CH($OR_2$)—$CH_2$—O—D—O—$CH_2$—CH($OR_2$)—$CH_2$—;

D is $C_2$–$C_{12}$alkylene; $C_4$–$C_{50}$alkylene which is interrupted by one or more oxygen atoms; phenylene; biphenylene or phenylene-E-phenylene;

E is —O—; —S—; —$SO_2$—; —$CH_2$—; —CO—; or —$C(CH_3)_2$—;

$R_x$ is hydrogen; hydroxyl; $C_1$–$C_{20}$alkyl; $C_4$–$C_{12}$cycloalkyl; $C_1$–$C_{20}$alkoxy; $C_4$–$C_{12}$cycloalkoxy; $C_4$–$C_{12}$cycloalkyl or $C_4$–$C_{12}$cycloalkyloxy which is interrupted by one or more oxygen atoms; $C_6$–$C_{12}$aryl; hetero-$C_3$–$C_{12}$aryl; —$OR_z$; $NHR_z$; $R_z$; CONR'R"; allyl; $C_2$–$C_{20}$alkenyl; $C_4$–$C_{12}$cycloalkenyl; $C_4$–$C_{12}$cycloalkenyl which is interrupted by one or more oxygen atoms; $C_3$–$C_{20}$alkynyl; or $C_6$–$C_{12}$cycloalkynyl;

$R_y$ is hydrogen; $C_1$–$C_{20}$alkyl; $C_4$–$C_{12}$cycloalkyl; $C_4$–$C_{12}$cycloalkyl which is interrupted by one or more oxygen atoms; $C_6$–$C_{12}$aryl; hetero-$C_3$–$C_{12}$aryl; $R_z$; allyl; $C_2$–$C_{20}$alkenyl; $C_4$–$C_{12}$cycloalkenyl which is uninterrupted or interrupted by one or more oxygen atoms; $C_3$–$C_{20}$alkynyl; or $C_6$–$C_{12}$cycloalkynyl;

$R_z$ is —COR'; —COOR'; —CONR'R"; —CO—CH═$CH_2$; or —CO—C($CH_3$)═$CH_2$; and

R' and R", independently of one another, are hydrogen; $C_1$–$C_{20}$alkyl; $C_4$–$C_{50}$alkyl which is interrupted by one or more oxygen atoms; $C_4$–$C_{12}$cycloalkyl; $C_4$–$C_{12}$cycloalkyl which is interrupted by one or more oxygen atoms; $C_2$–$C_{20}$alkenyl; $C_2$–$C_{20}$alkenyl which is interrupted by one or more oxygen atoms; or $C_6$–$C_{12}$aryl.

The radicals $R_x$, $R_y$, R' and R" may, independently of one another, be substituted by hydroxyl, —$NH_2$, —NHR', —NR'R", halogen, $C_1$–$C_{20}$alkyl, $C_1$–$C_{20}$alkoxy, $C_4$–$C_{12}$cycloalkyl, $C_4$–$C_{12}$cycloalkoxy, $C_2$–$C_{20}$alkenyl, $C_4$–$C_{12}$cycloalkyl, $C_3$–$C_{20}$alkynyl, $C_6$–$C_{12}$cycloalkynyl, $C_6$–$C_{12}$aryl, acylamino, acyloxy, sulfonyl, carboxyl, (meth)acryloxy, (meth)acrylamino,

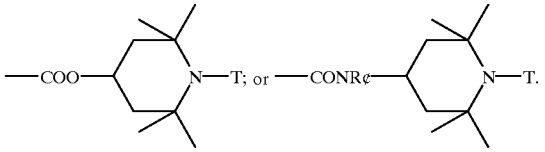

These radicals may also be isomer mixtures from the stated definitions.

Alkyl is branched or unbranched alkyl, such as methyl, ethyl, propyl, isopropyl, n-butyl, sec-butyl, isobutyl, t-butyl, 2-ethylbutyl, n-pentyl, isopentyl, 1-methylpentyl, 1,3-dimethylbutyl, n-hexyl, 1-methylhexyl, n-heptyl, isoheptyl, 1,1,3,3-tetramethylbutyl, 1-methylheptyl, 3-methylheptyl, n-octyl, 2-ethylhexyl, 1,1,3-trimethylhexyl, 1,1,3,3-tetramethylpentyl, nonyl, decyl, undecyl, 1-methylundecyl, dodecyl, 1,1,3,3,5,5-hexamethylhexyl, tridecyl, tetradecyl, pentadecyl, hexadecyl, heptadecyl or octadecyl.

$C_1$–$C_{20}$Alkoxy is a straight-chain or branched radical, for example methoxy, ethoxy, propoxy, butoxy, pentoxy, hexyloxy, heptyloxy, octyloxy, isooctyloxy, nonyloxy, undecyloxy, dodecyloxy, tetradecyloxy, pentadecyloxy, hexadecyloxy, heptadecyloxy, octadecyloxy, nonadecyloxy or eicosyloxy.

Phenylalkyl is phenyl-substituted alkyl. $C_7$–$C_{20}$Phenylalkyl can be, for example, benzyl, α-methylbenzyl, α,α-dimethylbenzyl, phenylethyl, phenylpropyl, phenylbutyl, phenylpentyl, phenylhexyl, phenylheptyl, phenyloctyl, phenylnonyl, phenyldecyl, phenyldodecyl or phenyltetradecyl.

Halogen is —F, —Cl, —Br or —I; preferably —F or —Cl, in particular —Cl.

$C_4$–$C_{12}$Cycloalkyl is, for example, cyclobutyl, cyclopentyl, cycloheptyl, cyclooctyl, cyclononyl, cyclodecyl, cycloundecyl, cyclodocecyl or in particular cyclohexyl.

Examples of $C_4$–$C_{12}$cycloalkyl which is interrupted by one or more oxygen atoms are, for example tetrahydrofuranyl, 1-oxa-4-cyclohexyl and 1,3-dioxa-4-cyclohexyl.

Alkenyl as defined above is, for example, allyl, isopropenyl, 2-butenyl, 3-butenyl, isobutenyl, n-penta-2,4-dienyl, 3-methyl-but-2-enyl, n-oct-2-enyl, n-dodec-2-enyl, iso-dodecenyl, n-dodec-2-enyl or n-octadec-4-enyl.

$C_2$–$C_{18}$Alkanoyl is, for example, acetyl, propionyl, acryloyl, methacryloyl or benzoyl.

$C_5$–$C_{12}$Cycloalkenyl is, for example, 2-cyclopenten-1-yl, 2,4-cyclopentadien-1-yl-, 2-cyclohexen-1-yl, 2-cyclohepten-1-yl or 2-cyclooctene-1-yl.

$C_4$–$C_{12}$Cycloalkoxy is, for example, cyclobutoxy, cyclopentoxy, cyclohexyloxy, cycloheptyloxy, cyclooctyloxy, cyclononyloxy, cyclodecyloxy, cycloundecyloxy, cyclodocecyloxy or in particular cyclohexyloxy.

Examples which may be mentioned of $C_6$–$C_{12}$aryl are, in particular, phenyl, naphthyl and biphenyl.

Hetero-$C_3$–$C_{12}$aryl is preferably pyridinyl, pyrimidinyl, triazinyl, pyrrolyl, furanyl, thiophenyl or quinolinyl.

A cyclic radical formed by $R_{11}$ and $R_{12}$ together with the phenyl radical is, for example, 3,4-dimethylenedioxyphenyl.

Acylamino or acyloxy $R_6$ to $R_{15}$ is generally $C_2$–$C_{12}$acylamino or -acyloxy.

Acyl is —CO—R, where R is an organic radical, usually having 1–11 carbon atoms, generally $C_1$–$C_{11}$alkyl, $C_2$–$C_{11}$alkenyl, $C_6$–$C_{10}$aryl, $C_7$–$C_{11}$phenylalkyl or $C_7$–$C_{11}$alkylphenyl.

The novel photographic recording material preferably includes compounds of the formula (1) or (1a) in which $R_1$ is hydrogen; $C_1$–$C_{24}$alkyl, $C_5$–$C_{12}$cycloalkyl or $C_7$–$C_{15}$phenylalkyl;

$R_6$ to $R_{15}$, independently of one another, are H; $C_1$–$C_{12}$alkyl, $C_2$–$C_6$alkenyl, Cl, F, OY, or OZ;

p is 1; and q is 0 or 1;

X, Y and Z, independently of one another, are $R_y$; $R_x$-substituted $C_1$–$C_{24}$alkyl; $C_2$–$C_{50}$alkyl which is interrupted by one or more oxygen atoms and substituted by one or more of the groups OH and/or $R_x$; or a radical of the formula $—CH((CH_2)_n—R_2)—CO—O—(CH_2)_m—R'_2$; $—CH((CH_2)_n—R_2)—CO—(NR')—(CH_2)_m—R'_2$; $—CO—(CH_2)_n—R_2$; $—CO—O—(CH_2)_n—R_2$; $—CH_2—CH(—O—(CO)—R_2)—R'_2$; or $—CO—NR'—(CH_2)_n—R_2$;

$R_2$ and $R'_2$, independently of one another, are $R_x$ if bonded to a carbon atom and $R_y$ if bonded to an atom other than carbon;

n is from 0 to 20; and m is from 0 to 20; and $R_x$ is hydrogen; hydroxyl; $C_1$–$C_{20}$alkyl; $C_4$–$C_{12}$cycloalkyl; $C_1$–$C_{20}$alkoxy; $C_6$–$C_{12}$cycloalkoxy; phenyl; $—OR_z$; $NHR_z$; $R_z$; allyl; or $C_1$–$C_{20}$alkyl, $C_2$–$C_{20}$alkoxy or $C_4$–$C_{12}$cycloalkyl which is substituted by hydroxyl, $C_1$–$C_{20}$alkyl, $C_1$–$C_{20}$alkoxy, acyloxy, carboxyl or (meth) acryloxy;

$R_y$ is hydrogen; $C_1$–$C_{20}$alkyl; $C_4$–$C_{12}$cycloalkyl; phenyl; $R_z$; allyl; or $C_1$–$C_{20}$alkyl or $C_4$–$C_{12}$cycloalkyl which is substituted by hydroxyl, $C_1$–$C_{20}$alkyl, $C_1$–$C_{20}$alkoxy, acyloxy, carboxyl or (meth)acryloxy;

$R_z$ is —COR'; —COOR'; —CONR'R"; $—CO—CH=CH_2$; or $—CO—C(CH_3)=CH_2$;

R' and R" independently of one another, are hydrogen; $C_1$–$C_{20}$alkyl; $C_4$–$C_{20}$alkyl which is interrupted by oxygen; $C_4$–$C_{12}$Cycloalkyl; $C_2$–$C_3$alkenyl; phenyl; or $C_1$–$C_{20}$alkyl or cyclohexyl which is substituted by hydroxyl, $C_1$–$C_{12}$alkyl, $C_1$–$C_{12}$alkoxy or carboxyl.

Of particular industrial importance are compounds of the formula (1) or (1a) in which p and q are each 1 and $R_1$ and $R_6$ to $R_{15}$ are hydrogen.

Particular preference is given to a recording material which includes one or more compounds of the formula (1) or (1a) in which $R_6$ to $R_{15}$, independently of one another, are H, $C_1$–$C_{12}$alkyl or Cl, and $R_{11}$, $R_{12}$ and $R_{13}$, in the case where q is 0, may alternatively be OH or OY;

p is 1;

X and Y, independently of one another, are $R_y$; $R_x$-substituted $C_2$–$C_{12}$alkyl; or $C_3$–$C_{30}$alkyl which is interrupted by one or more oxygen atoms and substituted by one or more of the groups OH and/or $R_x$;

$R_x$ is hydroxyl; $C_1$–$C_{12}$alkyl; $C_6$–$C_{12}$cycloalkyl; $C_1$–$C_{20}$alkoxy; $C_6$–$C_{12}$cycloalkoxy; phenyl; $—OR_z$; $R_z$; allyl; or $C_1$–$C_{20}$alkyl, $C_2$–$C_{20}$alkoxy or cyclohexyl, which is substituted by hydroxyl, $C_1$–$C_{12}$alkyl, $C_1$–$C_{12}$alkoxy or carboxyl;

$R_y$ is hydrogen; $C_1$–$C_{12}$alkyl; $C_6$–$C_{12}$cycloalkyl; phenyl; $R_z$; allyl; or $C_1$–$C_{20}$alkyl or cyclohexyl, which is substituted by hydroxyl, $C_1$–$C_{12}$alkyl, $C_1$–$C_{12}$alkoxy or carboxyl;

$R_z$ is —COR'; —COOR'; —CONR'R"; $—CO—CH=CH_2$; or $—CO—C(CH_3)=CH_2$;

R' and R", independently of one another, are hydrogen; $C_1$–$C_{20}$alkyl; $C_4$–$C_{20}$alkyl which is interrupted by oxygen; $C_4$–$C_{12}$cycloalkyl; or $C_2$–$C_{20}$alkyl or cyclohexyl which is substituted by hydroxyl, $C_1$–$C_{12}$alkyl, $C_1$–$C_{12}$alkoxy or carboxyl; in particular those in which $R_6$ to $R_{15}$ are H;

q is 1;

p is 1;

X and Y, independently of one another, are $R_y$; $R_x$-substituted $C_2$–$C_{12}$alkyl; or $C_3$–$C_{30}$alkyl which is interrupted by one or more oxygen atoms and substituted by one or more of the groups OH and/or $R_x$;

$R_x$ is hydroxyl; $C_1$–$C_{20}$alkoxy; cyclohexyloxy; $—OR_z$; $R_z$; or allyl;

$R_y$ is hydrogen; $C_1$–$C_{20}$alkyl; or cyclohexyl;

$R_z$ is —COR'; or —COOR';

R' is hydrogen; $C_1$–$C_{20}$alkyl; $C_4$–$C_{20}$alkyl which is interrupted by oxygen; cyclohexyl or $C_1$–$C_4$alkylcyclohexyl.

Also of importance as an addition to the novel photographic recording materials are compounds of the formula (1) or (1a) which conform to the formula (2)

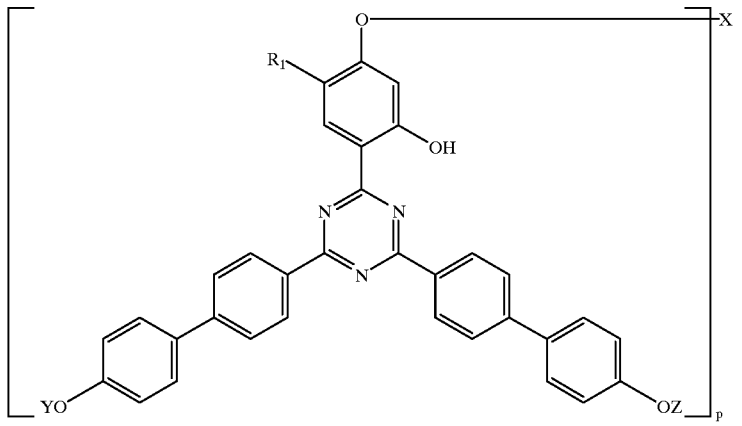

or

-continued (2a)

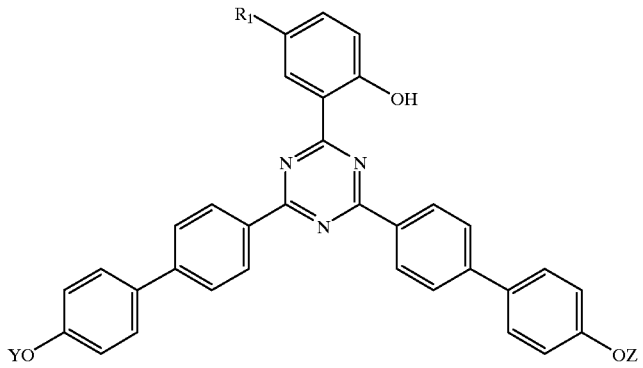

and in particular compounds of the formula (3)

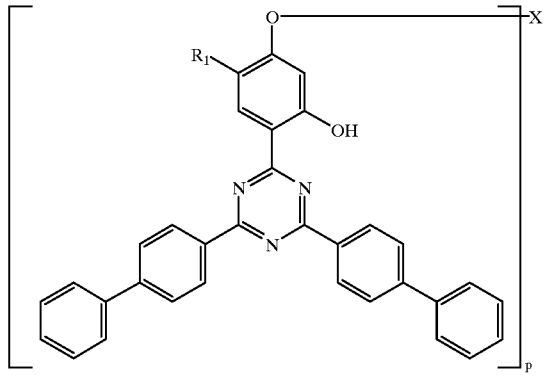

or (3a)

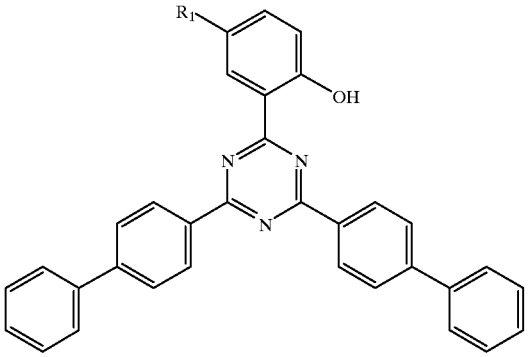

and in which $R_1$, X, Y, Z and p are as defined under the formula (1) or (1a).

Of the compounds of the formula (3) or (3a), preference is given to those in which X is $((CH_2)_m—CH_2—O—)_n—R_y$; $—(CH_2)_n—R_x$; or $—CH_2—CH(OH)—CH_2—O—(CH_2)_n—R_x$;

$R_x$ is hydrogen; hydroxyl; $C_1$–$C_{20}$alkyl; or $C_4$–$C_{12}$cycloalkyl;

$R_y$ is hydrogen; $C_1$–$C_{20}$alkyl; or $C_4$–$C_{12}$cycloalkyl;

m is from 0 to 20; and n is from 0 to 20, where the product (m+1) n is less than or equal to 50;

p is 1; and $R_1$ is as defined under the formula (1) or (1a).

Very particular preference is given to triazine compounds of the formulae (1) to (3) and (1a) to (3a) in which X, Y and Z, independently of one another, are hydrogen; $—((CH_2)_m—CH_2—O—)_n—R_2$; $—(CH_2—CH((CH_2)_m—R_2)—O—)_n—R'_2$; $—(CH((CH_2)_m—R_2)—CH_2—O—)_n—R'_2$; $—(CH_2)_n—R_2$; $—CH_2—CH(OH)—CH_2—O—(CH_2)_n—R_2$; $—CH_2—CH(OR_2)—CH_2—O—(CH_2)_n—R'_2$; $—CH_2—CH(OH)—CH_2—O—(CH_2)_n—OR_2$; or $—CH_2—CH(OR_2)—CH_2—O—(CH_2)_n—OR'_2$; and the product (m+2) n is less than or equal to 50.

The photographic recording material furthermore preferably includes compounds of the formula (4)

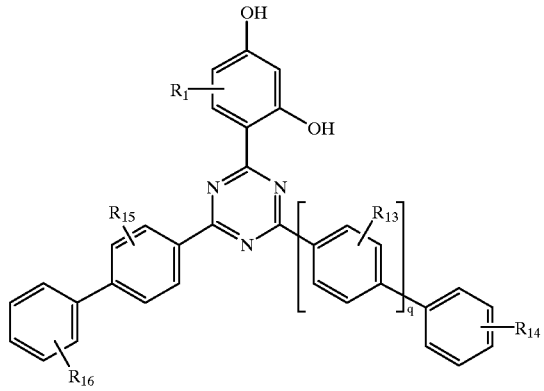

or (4a)

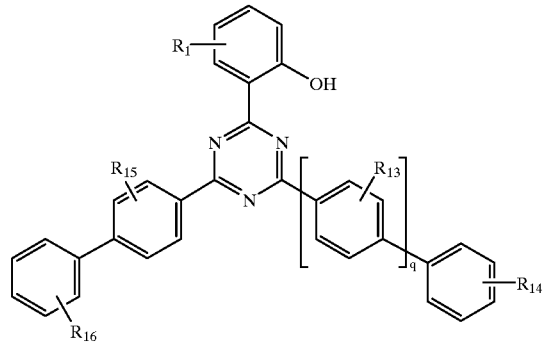

in which $R_1$ is hydrogen; $C_1$–$C_{20}$alkyl; $C_1$–$C_{20}$alkoxy; or halogen;

$R_{13}$ is hydrogen; $C_1$–$C_{20}$alkyl; $C_1$–$C_{20}$alkoxy; phenyl-$C_1$–$C_{20}$alkoxy; or halogen;

$R_{14}$ is hydrogen; $C_1$–$C_{20}$alkyl; $C_1$–$C_{20}$alkoxy; or halogen;

$R_{15}$ and $R_{16}$, independently of one another, are hydrogen; $C_1$–$C_{20}$alkyl; $C_1$–$C_{20}$alkoxy, or halogen; and q is 0 or 1, in particular compounds of the formula (4a) in which $R_1$ is hydrogen; $C_1$–$C_{20}$alkyl; or $C_1$–$C_{20}$alkoxy;

$R_{13}$, $R_{14}$, $R_{15}$ and $R_{16}$ are hydrogen; and q is 0 or 1.

Examples of novel stabilizers are, inter alia, 2-(2-hydroxyphenyl)-4-phenyl-6-(4-biphenylyl)-1,3,5-triazine, 2-(2,4-dihydroxyphenyl)-4,6-bis(4-biphenylyl)-1,3,5-triazine, 2-(2-hydroxy-4-hexyloxyphenyl)-4,6-bis(4-biphenylyl)-1,3,5-triazine, 2-(2,4-dihydroxyphenyl)-4,6-bis-(4-biphenylyl)-1,3,5-triazine, 2-[2-hydroxy-4-(2-hydroxy-3-butoxypropoxy)phenyl]-4,6-bis-(4-biphenylyl)-1,3,5-triazine, 2-(2-hydroxy-4-octyloxyphenyl)-4,6-bis(4-biphenylyl)-1,3,5-triazine, 2-[2-hydroxy-4-(2-hydroxy-3-dodecyloxypropoxy)phenyl]-4,6-bis(4-biphenylyl)-1,3,5-triazine, 2-[2-hydroxy-4-(2-hydroxy-3-tridecyloxypropoxy)phenyl]-4,6-bis(4-biphenylyl)-1,3,5-triazine, 2-(2-hydroxy-4-methoxyphenyl)-4-(2,4-dimethoxyphenyl)phenyl-6-(4-biphenylyl)-1,3,5-triazine, 2,4-bis(2-hydroxyphenyl)-6-(4-biphenylyl)-1,3,5-triazine, 2-(2-hydroxyphenyl)-4-(2-methoxyphenyl)-6-(4-biphenylyl)-1,3,5-triazine, 2-(2-hydroxyphenyl)-4-(4-methoxyphenyl)-6-(4-biphenylyl)-1,3,5-triazine; or 2-(2-hydroxy-4-methoxyphenyl)-4-6-bis(4-biphenylyl)-1,3,5-triazine.

The compounds of the formulae (1) to (4) and (1a) to (4a) which can be employed in accordance with the invention can be prepared, for example, analogously to one of the methods given in EP-A-434 608 or in the publication by H. Brunetti and C. E. Luthi, Helv. Chim. Acta 55, 1566 (1972), by Friedel-Crafts addition of halotriazines onto appropriate phenols. The products can then be converted into compounds of the formulae (1) to (4) and (1a) to (4a) by known methods. These reactions and processes are described, for example, in EP-A-434 608, page 15, line 11, to page 17, line 1. The compounds of the formulae (1) to (4) and (1a) to (4a) are disclosed in WO-96/28 431. Examples of known compounds are, inter alia, those mentioned below and the compounds of Examples 1–24 of WO-96/28 431; preparation processes are described in WO-96/28 431 on pages 9–13. Some other examples of the preparation compounds of the formula (1) are given below; in these examples, $^1$H-NMR denotes proton nuclear magnetic resonance; unless otherwise stated, at 300 MHz in $CDCl_3$ Ethylcellosolve denotes 2-ethoxyethanol m.p. denotes melting point or melting range.

EXAMPLE A1

9.9 g (0.02 mol) of compound A of the formula

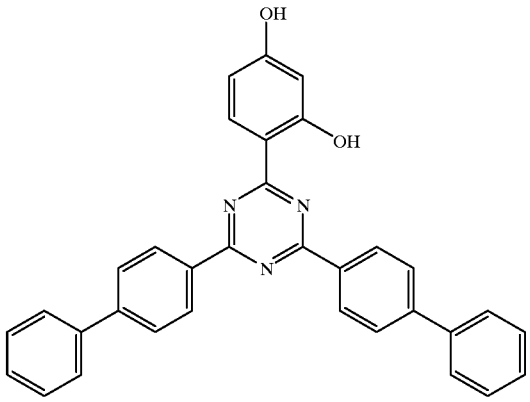

(Comp. A; preparation, see WO-96/28 431)

and 3 g (0.022 mol) of potassium carbonate are suspended in 50 ml of ethylcellosolve. The suspension is warmed to 110° C., and 3.6 g (0.022 mol) of 1-bromhexane are added dropwise. The mixture is stirred at 110° C. for 21 hours. Cooling forces the product to precipitate. The mixture is filtered, and the filter residue is washed with water, giving a product of the formula (compound A1)

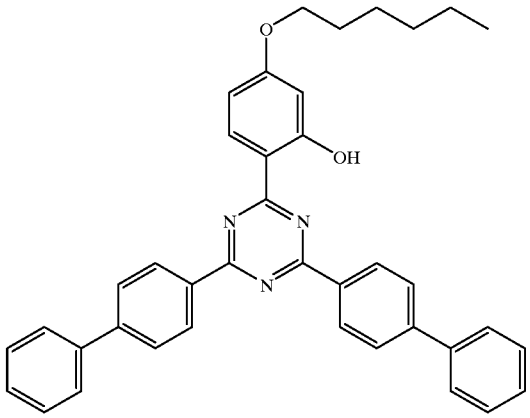

m.p.: 176–178° C.

EXAMPLE A2

8.5 g (0.0172 mol) of compound A (see Example A1), 3.4 g (0.025 mol) of butyl glycidyl ether and 0.5 g (0.0014 mol) of ethyltriphenylphosphonium bromide are suspended in 200 ml of xylene. The mixture is refluxed for 17 hours. The xylene is evaporated off, and the residue is recrystallized, giving 6.5 g of the compound A2 of the formula (A2)

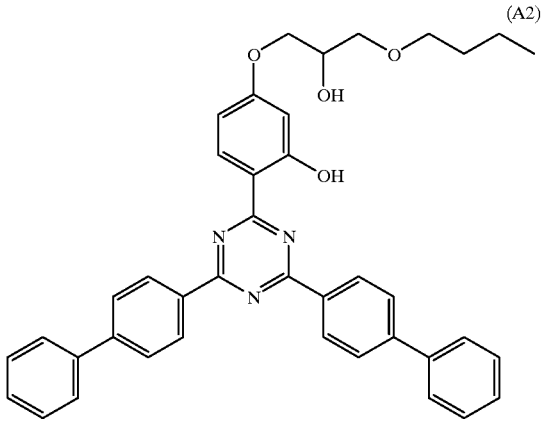

m.p.: 156–158° C.

EXAMPLE A3

9.4 g (0.019 mol) of 2-(2,4-dihydroxyphenyl)-4,6-bis(4-biphenylyl)-1,3,5-triazine (compound A), 2.6 g (0.019 mol) of potassium carbonate and 6.1 g (0.021 mol) of octyl 2-bromopentanoate (octyl isomer mixture) are suspended in 100 ml of ethyl methyl ketone. The mixture is stirred at 100° C. overnight, then filtered and evaporated. Chromatography on silica gel gives 6.3 g of a waxy product of the formula

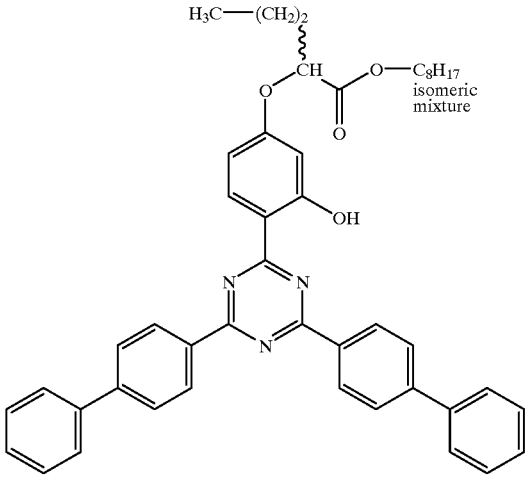

(compound A3); The $^1$H-NMR spectrum agrees with the formula.

EXAMPLES A4–A15

Further compounds of the formula 1 are obtained by the methods described in Examples A1, A2 and A3 using suitable analogous bromoalkanes, glycidyl compounds or α-brominated carboxylic esters instead of 1-bromohexane, butyl glycidyl ether or octyl 2-bromopentanoate. The structure, characterization and preparation method are shown in the table below. Radicals prefixed or suffixed by n are straight-chain; (i) indicates a mixture of various alkyl isomers of the same molecular weight.

TABLE A4

Compounds of the formula

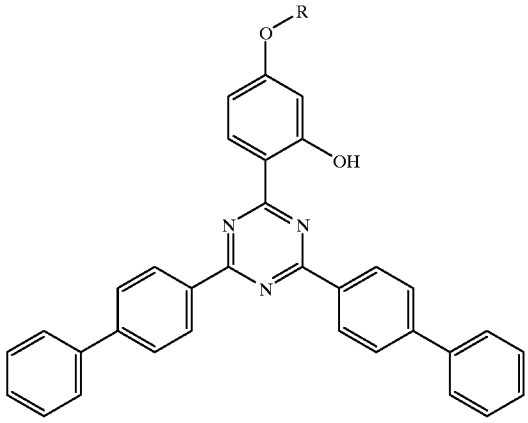

| No. | R | Preparation as in Ex. | m.p./° C. | Characterization |
|---|---|---|---|---|
| A4 | 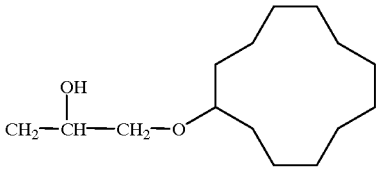 | A2 | 156–162 | $^1$H-NMR |
| A5 | CH(n-$C_3H_7$)—COO—$C_2H_5$ | A3 | 168–171 | $^1$H-NMR |

TABLE A4-continued

Compounds of the formula

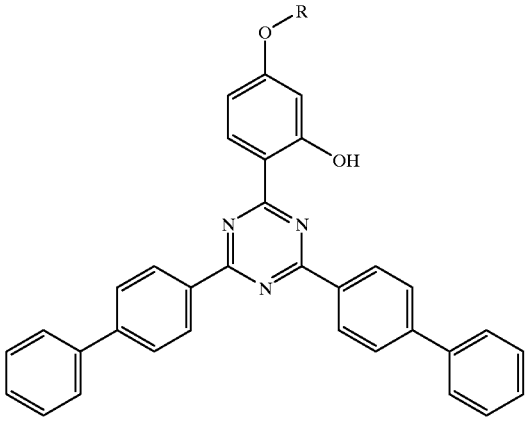

| No. | R | Preparation as in Ex. | m.p./° C. | Characterization |
|---|---|---|---|---|
| A6 | 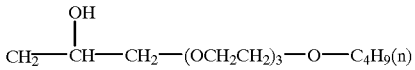 | A2 | | $^1$H-NMR |
| A7 | 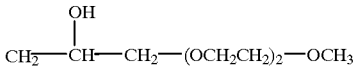 | A2 | 107–110 | $^1$H-NMR |
| A8 | $CH_2CH(C_2H_5)—C_4H_9(n)$ | A1 | 63–70 | $^1$H-NMR |
| A9 | $CH_2COO—C_6H_{17}(i)$ | A3 | 140–142 | $^1$H-NMR |
| A10 | 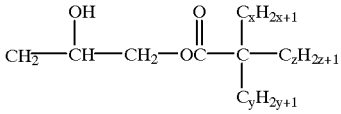 in which x, y and z are each in the range 1–6 and x + y + z = 8 | A2 | 156–158 | $^1$H-NMR |
| A11 | 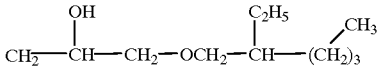 | A2 | 142–143 | $^1$H-NMR |
| A12 | $CH(n\text{-}C_6H_{13})—COO—C_2H_5$ | A3 | 157–159 | $^1$H-NMR |
| A13 | $CH(CH_3)—COO—C_2H_5$ | A3 | 177–178 | $^1$H-NMR |
| A14 | $CH(CH_3)—COO—C_8H_{17}(i)$ | A3 | 60–70 | $^1$H-NMR |
| A15 | $CH(n\text{-}C_4H_9)—COO—CH_3$ | A3 | 182–183 | $^1$H-NMR |
| A16 | 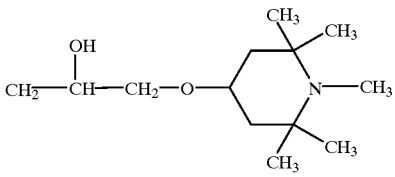 | A2 | 105 | $^1$H-NMR |
| A17 | $CH(n\text{-}C_3H_7)—COO—C_2H_5$ | A3 | | $^1$H-NMR |

EXAMPLE A18

30 g (48 mmol) of compound A17 are stirred at 100° C. for 2 hours together with 3.4 g (60 mmol) of finely powdered KOH in 300 ml of Ethylcellosolve. 100 ml of acetic acid are then added, causing the product to precipitate. The mixture is filtered, and the product is recrystallized from Ethylcellosolve, giving the free acid (m.p. 196–198° C.) of the formula

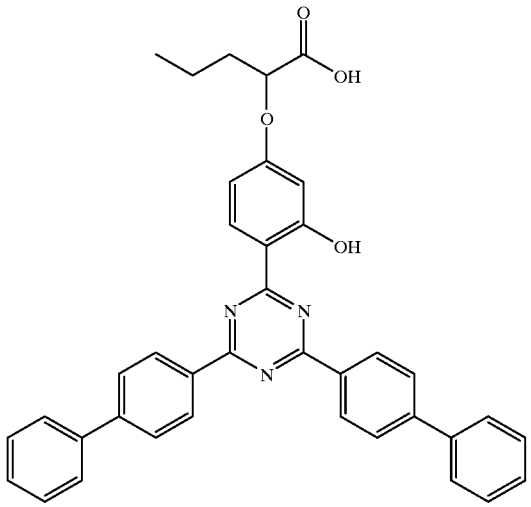

EXAMPLE A19

20 g (34 mmol) of the acid from Example A18 are suspended in 200 ml of toluene, and then 11.9 g (100 mmol) of thionyl chloride are added. After a few drops of dimethylformamide have been added, the reaction mixture is kept at the reflux temperature for 2 hours, and the solvent is then evaporated, giving the compound 2,4-bis(4-phenyl-phenyl)-6-(2-hydroxy-4-[1-chlorocarbonyl]butoxyphenyl)-1,3,5-triazine. 50 ml of dichloromethane are added to this crude product, giving a clear solution. 3.2 g (100 mmol) of methanol and 10.1 g (100 mmol) of triethylamine are then added, and the mixture is left to stand at room temperature for 5 hours. The reaction mixture is evaporated, and the product is chromatographed on silica gel, giving the compound of the formula

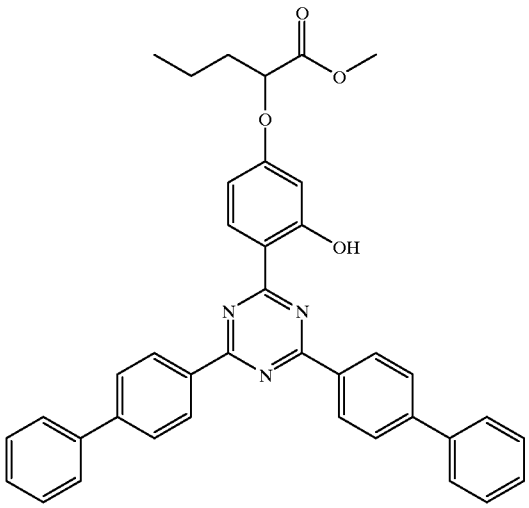

of m.p. 177–180° C.

EXAMPLES A20–A30

Further compounds of the formula I are obtained as described in Example A19 by esterifying the free acid. The structure, characterization and preparation method are shown in the table below. Radicals prefixed or suffixed by n are straight-chain; (i) denotes a mixture of various alkyl isomers of the same molecular weight.

TABLE A20

Compounds of the formula

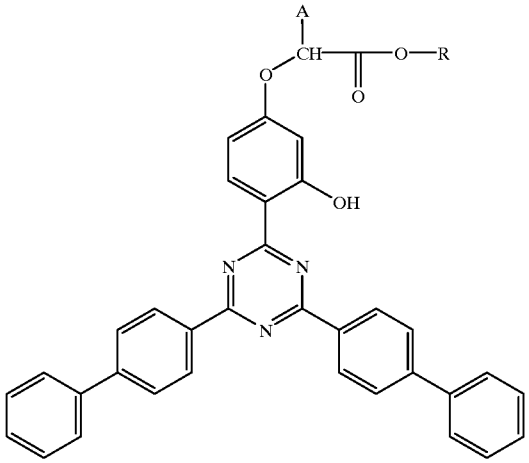

| No. | A | R | m.p./° C. | Characterization |
|---|---|---|---|---|
| A20 | n-Propyl | Methylcyclohexyl | 174–179 | $^1$H-NMR |
| A21 | n-Propyl | $CH_2CH(C_2H_5)—C_2H_5$ | $^1$H-NMR | |
| A22 | n-Propyl | $CH_2CH(CH_3)—C_2H_5$ | $^1$H-NMR | |
| A23 | n-Propyl | $CH(CH_3)—CH_2—CH(CH_3)—CH_3$ | 85–97 | $^1$H-NMR |
| A24 | n-Propyl | $CH_2—C(CH_3)_3$ | 143–145 | $^1$H-NMR |
| A25 | n-Propyl | $CH_2—CH_2—CH(CH_3)—CH_3$ | 152–154 | $^1$H-NMR |
| A26 | n-Propyl | n-$C_8H_{17}$ | | $^1$H-NMR |
| A27 | n-Propyl | n-$C_7H_{15}$ | 78–82 | $^1$H-NMR |

TABLE A20-continued

Compounds of the formula

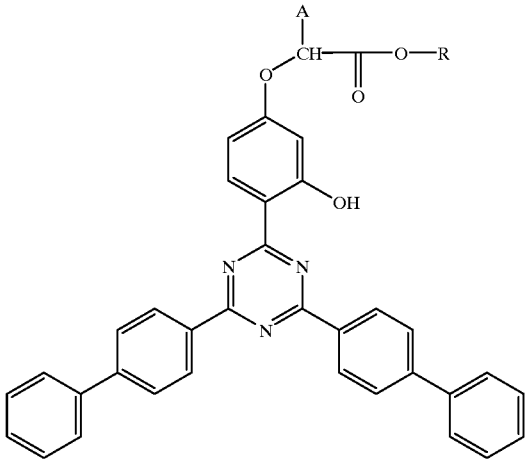

| No. | A | R | m.p./° C. | Characterization |
|---|---|---|---|---|
| A28 | Ethyl | Ethyl | 165–167 | $^1$H-NMR |
| A29 | n-Butyl | $C_8H_{17}$(i) | Wax | $^1$H-NMR<br>d = 13.52 ppm (s, 1H)<br>d = 8.61 ppm (s, 4H)<br>d = 6.59 ppm (d, 1H) |
| A30 | Ethyl | $C_8H_{17}$(i) | Wax | $^1$H-NMR:<br>d = 13.54 ppm (s, 1H)<br>d = 8.61 ppm (s, 4H)<br>d = 6.65 ppm (d, 1H) |

The biphenylyl-substituted triazine compounds are very good UV absorbers which are particularly distinguished by very high light absorption in the 300–400 nm region and high inherent stability. In addition, these compounds have high thermal stability. It is also surprising that the solubility and melting points of the stabilizers, in spite of the large conjugated aromatic system, are similar to the solubility and melting points of comparable compounds from the prior art. The compounds are therefore highly suitable for stabilizing photographic recording material, in particular against damage thereof by light, oxygen and/or heat.

The novel photographic recording materials also offer the advantage over materials which include conventional UV absorbers that the UV absorbers of the formula (1) or (1a) are required in comparatively small amounts, so that the thickness of the UV absorber-containing layer also remains low, which has, inter alia, a positive effect on the imaging properties.

Examples of colour-photographic materials are colour negative films, colour reversal films, colour positive films, colour photographic paper, colour reversal photographic paper, colour-sensitive materials for the dye diffusion transfer process or the silver dye bleaching process.

Suitable supports for the production of colour-photographic materials are, for example, films of semisynthetic and synthetic polymers, such as cellulose nitrate, cellulose acetate, cellusose butyrate, polystyrene, polyvinyl chloride, polyethylene terephthalate and polycarbonate, and paper laminated with a layer of barytes or α-olefin polymer (for example polyethylene). These supports may be coloured with dyes and pigments, for example titanium dioxide. They may also, for shielding against light, be coloured black. The surface of the support is generally subjected to a treatment to improve the adhesion of the photographic emulsion layer, for example a corona discharge treatment followed by application of a substrate layer.

The novel material preferably includes the silver-halide emulsion layers in the sequence blue-sensitive, green-sensitive and red-sensitive, starting from the support. In the novel colour-photographic material, the UV absorber is preferably present in a layer above the green-sensitive layer, particularly preferably in a layer above the silver-halide emulsion layer(s).

The novel UV absorber is preferably present in the photographic material in an amount of from 0.001 to 10 g/m$^2$, for example from 0.1 to 8 g/m$^2$, in particular from 0.005 to 6 g/m$^2$, especially from 0.01 to 3 g/m$^2$.

The novel colour-photographic recording material is preferably a material having the following layer sequence:

| | |
|---|---|
| a | a: protection layer |
| b | b: interlayer (may be omitted) |
| c | c: red-sensitive layer |
| d | d: interlayer |
| e | e: green-sensitive layer |
| f | f: interlayer |
| g | g: blue-sensitive layer |
| h | h: support |

Another example is a material having a similar layer structure, but in which layer a is omitted. The novel UV absorber of the formula (1) or (1a) is expediently, for example, present in layer a, b, c and/or d, in particular in a, b and/or c, especially in a and/or b, in the layer sequence shown.

In addition to the compound of formula (1) or (1a), the novel recording material includes a conventional UV absorber. The invention thus relates to a corresponding photographic recording material, in particular one in which at least one of the layers includes a conventional UV absorber whose long-wave absorption maximum is at a higher wavelength than that of the UV absorber of the formula (1) or (1a).

The photographic layers in the novel material, in particular layers b, c and/or d, in the colour-photographic material described above by way of example, may include further UV absorbers. Examples of such UV absorbers are benzotriazoles, 2-hydroxybenzophenones, oxanilides, cyanoacrylates, salicylates, acrylonitrile derivatives or thiazolines, and conventional 2-hydroxyphenyltriazines.

UV absorbers of these types are described in greater detail, for example, in the following publications: U.S. Pat. Nos. 3,314,794, 3,352,681, 3,705,805, 3,707,375, 4,045,229, 3,700,455, 3,700,458, 3,533,794, 3,698,907, 3,705,805, 3,738,837, 3,762,272, 4,163,671, 4,195,999, 4,309,500, 4,431,726, 4,443,543, 4,576,908, 4,749,643, 5,500,332, 5,455,152, GB-A-1 564 089, GB-A-2 293 608, EP-A-190 003, 747 755, 717 313 and JP-A-71/2784, 81/111 826, 81/27 146, 88/53 543, 88/55 542 and 96/69 087.

At least one of the layers preferably includes a conventional UV absorber from the 2-(2-hydroxyphenyl) benzotriazole or 2-(2-hydroxyphenyl)-1,3,5-triazine class.

The amount of conventional UV absorber used is preferably in the range given above for compounds of the formula (1) or (1a).

Of importance is a photographic recording material of the invention in which the conventional UV absorber is employed in the same layer as the UV absorber of the formula (1) or (1a).

Preference is also given to a photographic recording material which additionally includes a UV absorber from the 2-hydroxyphenyltriazine series which does not conform to the formula (1) or (1a), as described, for example, in U.S. Pat. Nos. 5,300,414, 5,489,503, 5,480,108, 4,826,978, EP-A-706 083, JP-A han 08-267 915 and U.S. Pat. No. 5,364,749.

Examples of particularly suitable compounds are the following: 2-hydroxyphenyltriazines of the formula

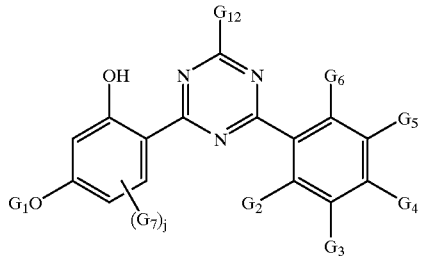

in which j is 0, 1, 2 or 3;

$G_1$ is alkyl, alkenyl or cycloalkyl;

$G_2$ and $G_6$, independently of one another, are H, OH, halogen, alkyl or halomethyl, for example $CF_3$;

$G_3$, $G_5$ and $G_7$, independently of one another, are H, OH, $OG_1$, halogen, alkyl or halomethyl, for example $CF_3$;

$G_4$ is H, OH, $OG_1$, halogen, alkyl, phenyl, halomethyl, for example $CF_3$ or alkenyl; and $G_{12}$ is alkyl, phenylalkyl, cycloalkyl, $OG_1$ or, in particular, a group of the formula

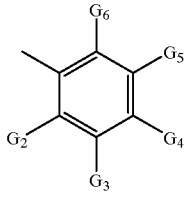

Any alkyl or alkenyl substituents or aromatic or aliphatic ring system substituents usually have, within the above definitions, from 1 to 50 carbon atoms and may be interrupted by one or more O, S, NR', $SO_2$, CO, phenylene, cyclohexylene, COO, OCO or —($SiR_pR_qO$)— atoms or groups and/or substituted by one or more OH, OR', NR'R", halogen, —CN, alkenyl, phenyl, —$SiR_pR_qR_r$ or COOH groups, where R' and R", independently of one another, are H, alkyl, alkenyl or acyl, and $R_p$, $R_q$ and $R_r$, independently of one another, are H, alkyl, alkenyl, phenyl, alkoxy, acyl or acyloxy.

The abovementioned groups may also carry further substituents. Dimers and polymers are also possible.

Preferred 2-hydroxyphenyltriazines from this class are, for example, those of the formulae (AIII)

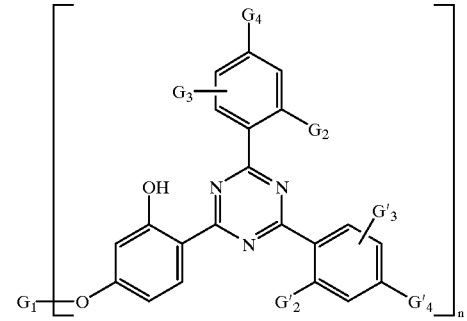

and (AV)

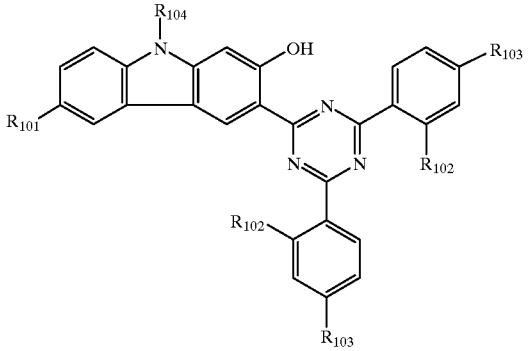

in which, in formula AIII, n is 1 or 2, und $G_1$ in the case where n=1, is alkyl or alkyl which is interrupted by one or more O atoms and/or substituted by one or more of the radicals OH, glycidyloxy, alkenyloxy, COOH, $COOR^e$, O—CO—$R^f$; alkenyl; cycloalkyl; phenylalkyl which is unsubstituted or substituted by OH, Cl or $CH_3$; $COR^g$; $SO_2$—$R^h$ or $CH_2CH(OH)$—$R^i$; where $R^e$ is alkyl; alkenyl; hydroxyalkyl; alkyl or hydroxyalkyl which is interrupted by one or more O atoms; cycloalkyl;

benzyl; alkylphenyl; phenyl; phenylalkyl; furfuryl; or $CH_2CH(OH)—R^j$;

$R^f$ and $R^g$, independently of one another, are alkyl, alkenyl or phenyl;

$R^h$ is alkyl, aryl or alkylaryl;

$R^j$ is aralkyl or $CH_2OR^k$;

$R^k$ is cyclohexyl, phenyl, tolyl or benzyl; and $G_1$, in the case where n=2, is alkylene; alkenylene; xylylene; alkylene or hydroxyalkylene which is interrupted by one or more O atoms; or hydroxyalkylene;

$G_2$ and $G'_2$, independently of one another, are H, alkyl or OH;

$G_4$ and $G'_4$, independently of one another, are H, alkyl, OH, alkoxy, halogen or in the case where n=1, $OG_1$;

$G_3$ and $G'_3$, independently of one another, are H, alkyl or halogen; and in which, in the formula AV, $R_{101}$ is H, $C_1$—$C_8$alkyl or $C_1$—$C_8$alkoxy;

$R_{102}$ and $R_{103}$, independently of one another, are H, halogen, OH, $C_1$–$C_8$alkyl or $C_1$–$C_8$alkoxy; and $R_{104}$ is H, OH, $C_1$–$C_8$alkyl or $C_1$–$C_8$alkoxy.

$G_1$, $G_2$, $G'_2$, $G_3$, $G'_3$, $G_4$ and $G'_4$ may, within the above definitions, also carry additional substituents, for example an ethylenic unsaturated, polymerizable group. Dimers and polymers are also possible.

Particularly preferred colour-photographic materials of the present invention are those in which at least one of the layers includes a UV absorber of the formula AIII in which n is 1;

$G_1$ is $C_1$–$C_{12}$alkyl which is unsubstituted or substituted by OH or $COOR^e$; $C_2$–$C_{12}$alkyl or $C_3$–$C_{15}$hydroxyalkyl which is interrupted by one or more O atoms; $C_3$–$C_6$alkenyl; cyclohexyl; $C_7$–$C_{11}$phenylalkyl; or $CH_2CH(OH)—R^j$; where $R^e$ is $C_1$–$C_{18}$alkyl; $C_3$–$C_7$alkenyl; or alkyl or hydroxyalkyl which is interrupted by one or more O atoms;

$R^j$ is $C_7$–$C_{12}$aralkyl or $CH_2OR^k$;

$R^k$ is cyclohexyl, phenyl, tolyl or benzyl; and $G_2$ and $G'_2$ are OH;

$G_4$ and $G'_4$ are $OG_1$;

$G_3$ and $G'_3$, independently of one another, are H or methyl; in particular those in which n is 1;

$G_1$ is $C_1$–$C_{12}$alkyl which is unsubstituted or substituted by $COOR^e$; $C_3$–$C_{15}$hydroxyalkyl which is interrupted by O; allyl; cyclohexyl; or benzyl; where $R^e$ is $C_1$–$C_{12}$alkyl; allyl; or $C_3$–$C_{12}$alkyl which is interrupted by one or more O atoms;

$G_2$ and $G'_2$ are OH;

$G_4$ and $G'_4$ are $OG_1$; and $G_3$ and $G'_3$ are H.

Examples of such compounds are, inter alia, 2,4,6-tris(2-hydroxy-4-octyloxyphenyl)-1,3,5-triazine, 2-(2,4-dihydroxyphenyl)-4,6-bis(2,4-dimethylphenyl)-1,3,5-triazine, 2,4-bis(2-hydroxy-4-propoxyphenyl)-6-(2,4-dimethylphenyl)-1,3,5-triazine, 2-(2-hydroxy-4-octyloxyphenyl)-4,6-bis(4-methylphenyl)-1,3,5-triazine, 2-(2-hydroxy-4-dodecyloxyphenyl)-4,6-bis(2,4-dimethylphenyl)-1,3,5-triazine, 2-[2-hydroxy-4-(2-hydroxy-3-butoxypropoxy)phenyl]-4,6-bis(2,4-dimethylphenyl)-1,3,5-triazine, 2-[2-hydroxy-4-(2-hydroxy-3-octyloxypropoxy)phenyl]-4,6-bis(2,4-dimethylphenyl)-1,3,5-triazine, 2-[2-hydroxy-4-(2-hydroxy-3-tridecyloxypropoxy)phenyl]-4,6-bis(2,4-dimethylphenyl)-1,3,5-triazine; and compounds of the following formulae:

Type (HPT-I)

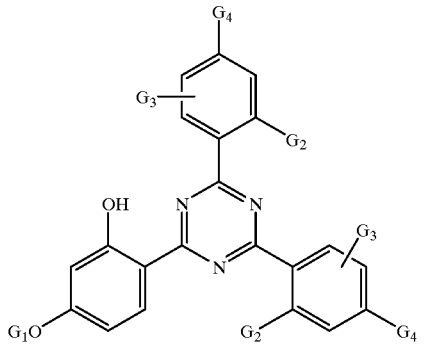

| No. | $G_1$ | $G_2$ | $G_4$ | $G_3$ |
|---|---|---|---|---|
| HPT-1 | $CH_2CH(OH)CH_2O—CO—C(CH_3)=CH_2$ | $CH_3$ | $CH_3$ | H |
| HPT-2 | $CH_2CH(OH)CH_2OC_{12}H_{25}C_{13}H_{27}$(mixture) | $CH_3$ | $CH_3$ | H |
| HPT-3 | $CH_2CH(OH)CH_2O—C_4H_9$(n) | $CH_3$ | $CH_3$ | H |
| HPT-4 | $CH_2COO—C_{18}H_{37}$ | H | H | m-$CF_3$ |
| HPT-5 | $C_8H_{17}$ | $CH_3$ | $CH_3$ | H |
| HPT-6 | $CH_2CH(OH)CH(C_2H_5)—C_4H_9$(n) | $CH_3$ | $CH_3$ | H |
| HPT-6a | H | $CH_3$ | $CH_3$ | H |
| HPT-6b | $CH_2CH_2OH$ | H | H | H |
| HPT-6c | $C_8H_{17}$ | H | H | H |

-continued

Type (HPT-II)

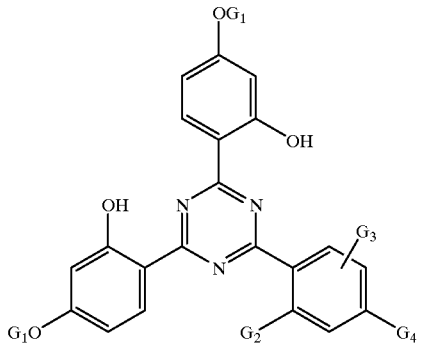

| No. | $G_1$ | $G_2$ | $G_4$ | $G_3$ |
|---|---|---|---|---|
| HPT-7 | $C_{18}H_{37}$ | $CH_3$ | $CH_3$ | o-$CH_3$ |
| HPT-8 | $CH_2CH(OH)CH_2O—C_4H_9(n)$ | H | H | H |
| HPT-9 | $CH_2CH(OH)CH_2O—C_4H_9(n)$ | $CH_3$ | $CH_3$ | H |
| HPT-10 | $CH_2CH(OH)CH_2O—C_4H_9(n)$ | $CH_3$ | $CH_3$ | o-$CH_3$ |
| HPT-11 | $CH_2CH(OH)—C_4H_9(n)$ | $CH_3$ | $CH_3$ | 0-$CH_3$ |
| HPT-12 | $CH(OH)—C_5H_{11}(n)$ | $CH_3$ | $CH_3$ | o-$CH_3$ |
| HPT-13 | $C_8H_{17}$ | H | Cl | H |
| HPT-14 | $CH(CH_3)—COO—C_2H_5$ | $CH_3$ | $CH_3$ | 0-$CH_3$ |
| HPT-15 | $CH_2CH(OCOCH_3)CH(C_2H_5)—C_4H_9(n)$ | H | H | H |
| HPT-16 | $CH_2CH(OH)CH(C_2H_5)—C_4H_9(n)$ | H | H | H |
| HPT-17 | $CH_2CH_2—O—CO—C(CH_3)_3$ | H | H | H |
| HPT-18 | H | H | H | H |
| HPT-19 | $(CH_2)_{10}COO—C_2H_5$ | H | Cl | H |
| HPT-20 | $(CH_2)_5COOH$ | H | H | H |
| HPT-21 | $CH_2CH(C_2H_5)—C_4H_9(n)$ | H | H | H |
| HPT-22 | $CH_2CH(OH)CH_2—O—C_4H_9(n)$ | H | t-$C_4H_9$ | H |
| HPT-23 | $CH_2CH(OH)CH_2—O—C_4H_9(n)$ | H | $OCH_3$ | H |
| HPT-24 | $(CH_2)_3—Si(CH_3)_3$ | H | H | H |

Type (HPT-III)

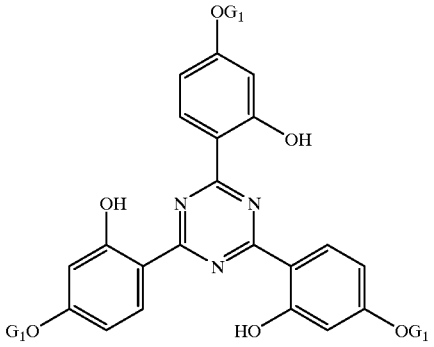

| No. | $G_1$ |
|---|---|
| HPT-26 | Cyclohexyl |
| HPT-26a | 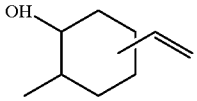 |
| HPT-26b | $CH_2CH(OH)CH_2$—O-2-butyl/2-pentyl (mixture) |
| HPT-27 | $CH_2CH(OH)CH_2—O—C_4H_9(n)$ |
| HPT-28 | $(CH_2)_{10}COO—C_2H_5$ |
| HPT-29 | $CH_2CH(OH)CH(C_2H_5)—C_4H_9(n)$ |
| HPT-30 | $C_4H_9$ |
| HPT-31 | $CH_2CH(OH)CH_2$—O-ethyl/isopropyl/$C_4H_9(n)$ (mixture) |
| HPT-32 | $CH(C_3H_7)_2$ |
| HPT-33 | Cyclopentyl |
| HPT-34 | $CH_2CH(OH)CH_2—O—CH_2CH_2—O—CH(CH_3)C_2H_5$ |

-continued
Type (HPT-IV)
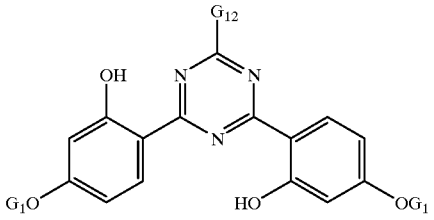
| No | $G_1$ | $G_{12}$ |
|---|---|---|
| HPT-35 | $CH_3$ | $OCH_2CH_2OC_2H_5$ |
| HPT-36 | $CH_2CH(OCOCH_3)CH(C_2H_5)—C_4H_9(n)$ | $OCH_3$ |
| HPT-37 | $CH_2CH_2CH_2—O—CO—C_2H_5$ | $OCH_3$ |
| HPT-38 | $CH_2CH(OH)CH_2—O—C_4H_9(n)$ | $CH_3$ |
| HPT-39 and HPT-41 | $CH_2CH(OH)CH_2—O—C_4H_9(n)$ | $OCH_3$ |
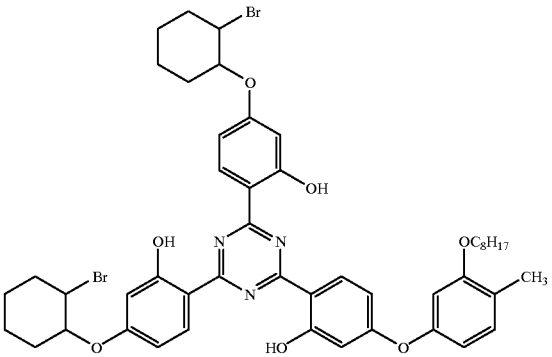
HPT-42
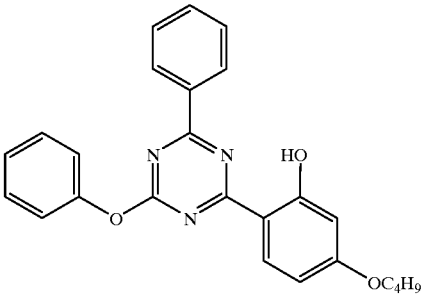
Type (HPT-V)
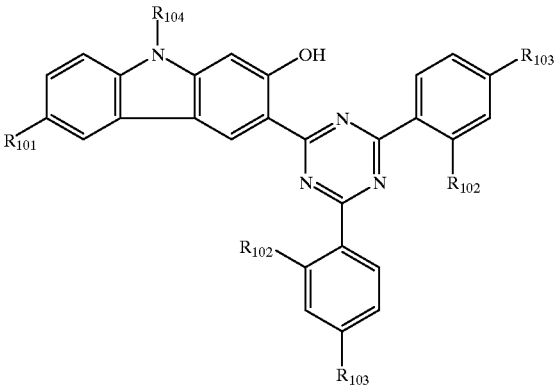
| No. | $R_{101}$ | $R_{102}$ | $R_{103}$ | $R_{104}$ |
|---|---|---|---|---|
| HPT-43 | H | H | H | H |
| HPT-44 | H | $CH_3$ | $CH_3$ | H |
| HPT-45 | H | OH | H | H |
| HPT-46 | H | OH | H | $CH_3$ |

-continued

| | | | | |
|---|---|---|---|---|
| HPT-47 | H | $OCH_3$ | $OCH_3$ | H |
| HPT-48 | $CH_3$ | H | H | H |

Abbreviations used in the above formulae:

i=isomer mixture; n=straight-chain radical; t=tertiary radical; o-, m- and p- denote the position of the radical relative to the triazine ring.

Benzotriazole compounds of the formula AII (AII)

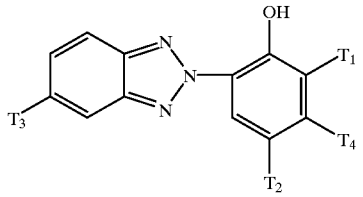

in which $T_1$ and $T_2$, independently of one another, are hydrogen, halogen, alkyl, alkyl which is substituted by $COOT_5$, alkoxy, aryloxy, hydroxyl, aralkyl, aryl or acyloxy, where $T_5$ is alkyl or alkyl which is interrupted by one or more O atoms, or $T_1$ is a group of the formula

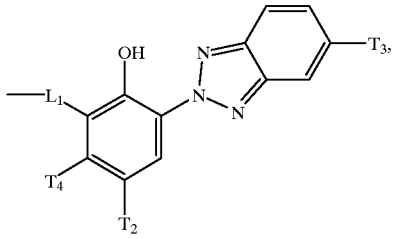

in which $L_1$ is a divalent group, for example $—(CH_2)_n—$, where n is in the range from 1–8, $T_3$ is hydrogen, halogen, alkyl, alkoxy, aryloxy, acyloxy, $—CF_3$, phenyl, $—S—T_6$ or $—SO_2—T_6$; and $T_4$ is hydrogen, hydroxyl, alkoxy, aryloxy or acyloxy or a group of one of the formulae $—OCH_2CH(OT_8)—CH_2—O—T_7$ and $—OCH_2CH_2—O—CO—T_7$;

$T_6$ is alkyl or aryl;

$T_7$ is alkyl or aryl;

$T_8$ is hydrogen or $CO—T_9$;

$T_9$ is alkyl or alkenyl;

and polymers prepared using these compounds. Preference is given to compounds of the formula AII which are liquid in the temperature range around 20° C. or form a liquid phase in a mixture with other substances, in particular those in which $T_1$ and $T_2$, independently of one another, are hydrogen, halogen, alkyl, alkyl which is substituted by $COOT_5$, alkoxy, aryloxy, hydroxyl, aralkyl, aryl or acyloxy, where $T_5$ is alkyl or alkyl which is interrupted by one or more O atoms.

$T_1$, $T_2$, $T_3$ and $T_4$ may also, within the above definitions, carry additional substituents, for example an ethylenically unsaturated, polymerizable group. Dimers and polymers are also possible.

Particular preference is given to compounds of the formula AII, in which $T_1$ is H, $C_1$–$C_{12}$alkyl or 1,1-dimethylbenzyl;

$T_2$ is H, $C_1$–$C_{12}$alkyl, 1,1-dimethylbenzyl or $CH_2CH_2COOT_5$;

$T_3$ is chlorine, $CF_3$, $—S—T_6$ or $—SO_2—T_6$;

$T_4$ is hydrogen or $C_1$–$C_{18}$alkoxy;

$T_5$ is $C_1$–$C_{18}$alkyl or $C_3$–$C_{18}$alkyl which is interrupted by one or more O atoms; and $T_6$ is phenyl.

The alkyl, alkenyl, aryl, arylalkyl, acyl, alkoxy, alkenyloxy, aryloxy, arylalkoxy, acyloxy radicals in conventional UV absorbers are generally those which are conventional in industry; preferred radicals are generally of the type defined above for the novel compounds of the formula (1) or (1a) with respect to the chain length, number of carbon atoms and, if present, hetero atoms, etc.

Examples of benzotriazoles (HBT) of the formula AII are the following:

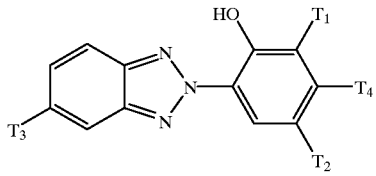

| HBT No. | $T_1$ | $T_2$ | $T_3$ | $T_4$ |
|---|---|---|---|---|
| HBT-1 | H | $CH_3$ | H | H |
| HBT-2 | H | $C(CH_3)_3$ | H | H |
| HBT-3 | $C(CH_3)_3$ | $CH_3$ | Cl | H |
| HBT-4 | $C(CH_3)_3$ | $C(CH_3)_3$ | Cl | H |
| HBT-5 | $C(CH_3)_2C_2H_5$ | $C(CH_3)_2C_2H_5$ | H | H |
| HBT-6 | $CH(CH_3)C_2H_5$ | $C(CH_3)_3$ | H | H |
| HBT-7 | 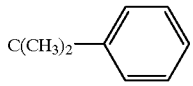 | 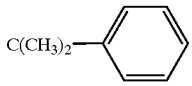 | H | H |
| HBT-8 | $C(CH_3)_3$ | $CH_2CH_2COOC_8H_{17}$ (isomers)* | Cl | H |

-continued

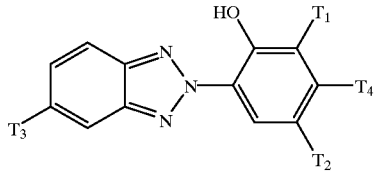

| HBT No. | $T_1$ | $T_2$ | $T_3$ | $T_4$ |
|---|---|---|---|---|
| HBT-9 | $C(CH_3)_3$ | $CH_2CH_2COOC_8H_{17}$ (isomers)* | H | H |
| HBT-10 | $C_{12}H_{25}$ (isomers)* | $CH_3$ | H | H |
| HBT-11 | 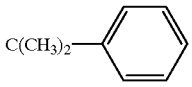 | $—C(CH_3)_2—C(CH_3)_3$ | H | H |
| HBT-12 | H | H | H | $O(CH_2)_2—O—CO—C(CH_3)=CH_2$ |
| HBT-13 | H | H | Cl | 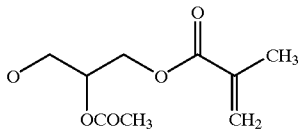 |
| HBT-14 | H | H | H | 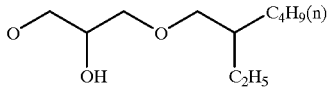 |
| HBT-15 | sec-$C_4H_9$ | sec-$C_4H_9$ | Cl | H |

*Main product

Other suitable UV absorbers are those of the formula AIII (AIII)

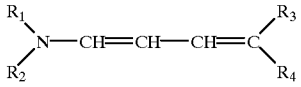

in which $R_1$ and $R_2$ are $—C_6H_{13}(n)$; $R_3$ and $R_4$ are —CN $R_1$ and $R_2$ are $—C_2H_5$; $R_3$ is $—SO_2$ 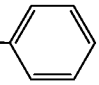 ;

$R_4$ is $—CO—OC_8H_{17}$ $R_1$ and $R_2$ are $—C_2H_5$; $R_3$ is $—SO_2$ 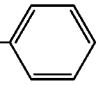 ;

$R_4$ is $—COO—C_{12}H_{25}$ $R_1$ and $R_2$ are $—CH_2=CH—CH_2$; $R_3$ and $R_4$ are —CN

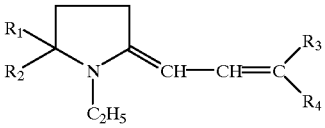

$R_1$ and $R_2$ are H; $R_3$ is —CN; $R_4$ is $—CO—NHC_{12}H_{25}$

-continued $R_1$ and $R_2$ are $—CH_3$; $R_3$ is —CN; $R_4$ is $—CO—NHC_{12}H_{25}$

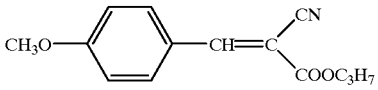

It is also possible to use ultraviolet-absorbent couplers (such as cyan couplers of the α-naphthol type) and ultraviolet-absorbent polymers. These ultra-violet absorbents can be fixed in a specific layer by means of mordants.

The novel recording material preferably furthermore includes, in the red-sensitive silver-halide emulsion layer, a cyan coupler of the formula (E-12)

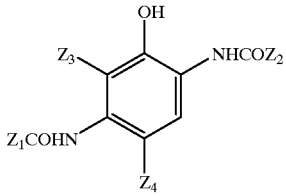

and/or of the formula

-continued (E-13)

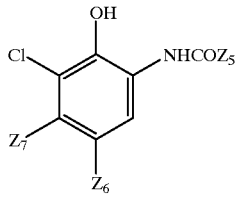

in which $Z_1$ is $C_1$–$C_{18}$alkyl or $C_6$–$C_{10}$aryl, $Z_2$ is $C_1$–$C_{18}$alkyl, $C_5$–$C_{12}$cycloalkyl, $C_6$–$C_{10}$aryl, an N-, S- or O-heterocyclic group containing 3–9 carbon atoms, or a ballast group, $Z_3$ is hydrogen or halogen, or $Z_1$ and $Z_3$ together form a ring, and $Z_4$ is hydrogen or a leaving group, and $Z_5$ is a ballast group, $Z_6$ is hydrogen or a leaving group, and $Z_7$ is $C_1$–$C_{18}$alkyl, and/or, in the green-sensitive silver-halide emulsion layer, a magenta coupler of the class represented by the formula

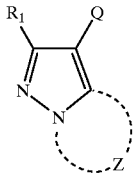

in which $R_1$ is hydrogen or an organic substituent, Z represents the nonmetallic atoms necesssary to complete a 5-membered ring having 2 or 3 nitrogen atoms, it being possible for this ring to be substituted, and Q is hydrogen or a leaving group, or a magenta coupler of the formula

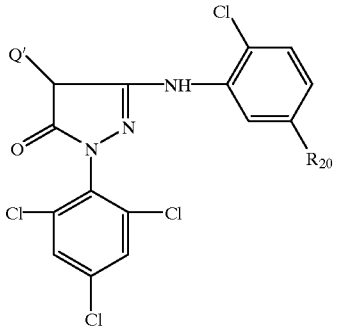

in which $R_{20}$ is hydrogen, $C_1$–$C_{20}$alkyl, $C_2$–$C_{30}$acylamino, carbamoyl, sulfamoyl, sulfonamido, alkoxycarbonyl, acyloxy or a urethane group, and Q' is a leaving group.

Further information on the structure of colour-photographic material and components which can be employed in the novel material is given, inter alia, in U.S. Pat. No. 5,538,840, column 27, line 25, to column 106, line 16; these parts of U.S. Pat. No. 5,538,840 are incorporated herein by way of reference.

Further mention of processes and/or components is given, inter alia, in the publications EP-A-499 279, 514 896, 694 590, 717 313, 740 204, 740 205, 740 206, 747 755, 751 428 and 751 425, EP-B-482 552 and 515 674; DE-A-19 516 166, 19 525 666, and 19 517 072; JP-A han 08-029 933, 08-160 578, 08-160 577, 08-160 576, 08-166 659, 08-267 915, 08-286 338, 08-234 381, 08-292 528 and 09-005 959; U.S. Pat. Nos. 4,248,962, 4,409,323, 4,861,701, 5,437,962, 5,455,152, 5,484,696, 5,491,054, 5,534,390, 5,500,332, 5,605,787, 5,523,199, 5,547,825 and 5,591,568.

The present invention furthermore relates to a process for stabilizing colour-photographic recording material comprising, on a support, at least one silver-halide emulsion layer and, if desired, at least one interlay and/or at least one protection layer, which comprises adding a UV absorber of the formula (1) or (1a) to at least one of said layers.

The present invention furthermore relates to the use of a compound of the formula (1) or (1a) for stabilizing colour-photographic recording material comprising, on a support, at least one silver-halide emulsion layer, and if desired, at least one interlayer and/or at least one protection layer.

The preferences described in greater detail above under the novel photographic recording material apply correspondingly to the novel process, the novel use and the novel compounds of the formula (1) or (1a).

Use examples: The following stabilizers of the formula (1) or (1a) are used:

Type of the formula

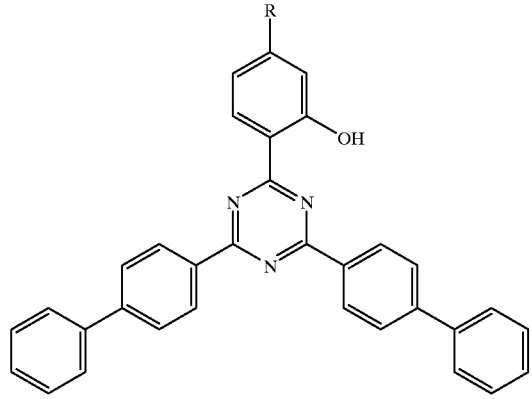

| Compound No. | R | |
|---|---|---|
| I | 2-ethylhexyloxy | (=compound from Example A8) |
| II | H | |
| III | —O—$CH_2$COO—$C_8H_{17}$ | (=compound from Example A9) |
| XIV | 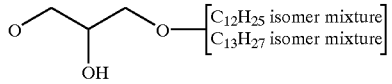 | |

EXAMPLE 25

A gelatine layer of the following composition (per $m^2$) is applied in a conventional manner to a polyester support.

| Component | Amount |
|---|---|
| Gelatine | 1200 mg |
| Tricresylphosphate | 510 mg |
| Hardener | 40 mg |
| Wetting agent | 100 mg |
| Comp. of the formula (1) | 225 mg |

The hardener is the potassium salt of 2-hydroxy-4,6-dichloro-1,3,5-triazine.

The wetting agent is sodium 4,8-diisobutylnaphthalene-2-sulfonate.

The gelatine layers are dried for 7 days at 20° C.

Use of the novel compound (XIV) gives clear, transparent layers which are suitable, for example as UV filter layer, for a photographic recording material.

EXAMPLE 26

A gelatine layer containing silver bromide and a coupler (M-9) from the following table is applied to a polyethylene-coated support material:

| Sample | Coupler (Amount) | Amount of TCP |
|---|---|---|
| 26-1 | M-9 (325 mg/m$^3$) | 162 mg/m$^3$ |
| 26-2 | M-2 (417 mg/m$^3$) | 208 mg/m$^3$ |
| 26-3 | Y-8 (927 mg/m$^3$) | 309 mg/m$^3$ |

The gelatine layer additionally includes the following components (per m$^2$ of support material):

| Component | AgBr layer |
|---|---|
| Gelatine | 5.15 g |
| Hardener | 300 mg |
| Wetting agent | 85 mg |
| Silver bromide | 260 mg |

The hardener used is the potassium salt of 2,4-dichloro-6-hydroxytriazine, and the wetting agent used is the sodium salt of diisobutylnaphthalenesulfonic acid.

A step wedge having a density difference of 0.3 log E per step is exposed onto each of the samples obtained in this way and then processed in accordance with the manufacturer's instructions for the Agfa P-94 process for colour negative papers.

After exposure and processing, the remission density is measured in the green region for the magenta step at a wedge density of between 0.9 and 1.1.

A UV absorber filter which includes the compound (XIV) is prepared on a transparent support material as described in Example 25.

The wedge is then exposed behind the UV absorber filter in an atlas exposure unit at 15 kJ/cm$^2$, and the remission density is re-measured. The drop in colour density (-DD) is greatly reduced when the compound (XIV) is used as stabilizer compared with a sample containing no stabilizer, as can be seen from the following table:

| Sample | Total light energy | -DD without comp. (XIV) | -DD with comp. (XIV) |
|---|---|---|---|
| 26-1 | 7.5 kJ/cm$^2$ | 48% | 33% |
| 26-2 | 15 kJ/cm$^2$ | 93% | 27% |
| 26-3 | 15 kJ/cm$^2$ | 69% | 12% |

EXAMPLE 27

The procedure is as described in Example 25, but a mixture of a novel stabilizer of the formula (1) and a conventional UV absorber (UVA) is employed in such a way that a filter having an optical density of 2.0 (measured at the long-wave maximum ($I_{max}$) at about 350 nm) is obtained. Clear, transparent layers are obtained which are suitable for a photographic recording material. The comparison used is a filter layer containing no novel UVA. The total amount of stabilizer necessary and the ratio by weight of novel/conventional UVA are shown in the table below.

TABLE 27

Total amount of novel/conventional UVA needed to achieve an optical density of 2.0 at $I_{max}$

| Sample | Novel UVA | Conventional UVA | Weight ratio | Total amount |
|---|---|---|---|---|
| 27-1 | none | HBT-10 | — | 647 mg/m$^2$ |
| 27-2 | Comp. XIV | HBT-10 | 1/9 | 593 mg/m$^2$ |
| 27-3 | Comp. XIV | HBT-10 | 1/6 | 582 mg/m$^2$ |
| 27-4 | Comp. XIV | HBT-10 | 1/3 | 519 mg/m$^2$ |
| 27-5 | none | HPT-7 | — | 550 mg/m$^2$ |
| 27-6 | Comp. XIV | HPT-7 | 1/2 | 508 mg/m$^2$ |
| 27-7 | none | HBT-5 | — | 532 mg/m$^2$ |
| 27-8 | Comp. XIV | HBT-5 | 1/9 | 513 mg/m$^2$ |
| 27-9 | Comp. XIV | HBT-5 | 1/6 | 505 mg/m$^2$ |
| 27-10 | Comp. XIV | HBT-5 | 1/3 | 482 mg/m$^2$ |
| 27-11 | none | HPT-26a | — | 535 mg/m$^2$ |
| 27-12 | Comp. I | HPT-26a | 1/9 | 518 mg/m$^2$ |
| 27-13 | Comp. I | HPT-26a | 1/6 | 509 mg/m$^2$ |
| 27-14 | Comp. I | HPT-26a | 1/3 | 448 mg/m$^2$ |

It can clearly be seen that the use of the novel stabilizers allows the total amount of stabilizer and thus the layer thickness to be reduced.

EXAMPLE 28

A photographic material having the following layer structure is produced:

| |
|---|
| Top layer |
| Red-sensitive layer |
| Second gelatine interlayer |
| Green-sensitive layer |
| First gelatine interlayer |
| Blue-sensitive layer |
| Polyethylene support |

The gelatine layers comprise the following components (per m$^2$ of support material):

Blue-Sensitive Layer

α-(3-Benzyl-4-ethoxyhydantoin-1-yl)-α-pivaloyl-2-chloro-5-[α-(2,4-di-t-amylphenoxy)butanamido]acetanilide (400 mg)

α-(1-Butylphenylurazol-4-yl)-α-pivaloyl-5-(3-dodecansulfonyl-2-methylpropanamido)-2-methoxyacetamide (400 mg)

Dibutyl phthalate (130 mg)

Dinonyl phthalate (130 mg)

Gelatine (1200 mg)

1,5-Dioxa-3-ethyl-3-[β-(3,5-di-t-butyl-4-hydroxyphenyl) propionyloxymethyl]-8,10-diphenyl-9-thia-[5,5] spiroundecane (150 mg)

Bis(1-acryloyl-2,2,6,6-tetramethyl-4-piperidyl) 2,2-bis(3,5-di-t-butyl-4-hydroxybenzyl)malonate (150 mg)

2,4-di-t-amylphenyl 3,5-di-t-butyl-4-hydroxybenzoate (150 mg)

Poly(N-t-butylacrylamide) (50 mg)

Blue-sensitive silver-chlorobromide emulsion (240 mg)

First Gelatine Interlayer

Gelatine (1000 mg)

2,5-Di-t-octylhydroquinone (100 mg)

Hexyl 5-[2,5-dihydroxy-4-(4-hexyloxycarbonyl-1,1-dimethylbutyl)phenyl]-5-methylhexanoate (100 mg)

Dibutyl phthalate (200 mg)

Diisodecyl phthalate (200 mg)

Green-Sensitive Layer

7-Chloro-2-{2-[2-(2,4-di-t-amylphenoxy)octanamido]-1-methylethyl}-6-methyl-1H-pyrazolo[1,5-b][1,2,4]triazole (100 mg)

6-t-Butyl-7-chloro-3-(3-dodecanesulfonylpropyl)-1H-pyrazolo[5,1-o][1,2,4]triazole (100 mg)
Dibutyl phthalate (100 mg)
Dicresyl phosphate (100 mg)
Trioctyl phosphate (100 mg)
Gelatine (1400 mg)
3,3,3',3'-Tetramethyl-5,5',6,6'-tetrapropoxy-1,1'-spirobiindane (100 mg)
4-(i-Tridecyloxyphenyl)thiomorpholine 1,1-dioxide (100 mg)
4,4'-Butylidenebis(3-methyl-6-t-butylphenol) (50 mg)
2,2'-Isobutylidenebis(4,6-dimethylphenol) (10 mg)
Ethyl 3,5-dichloro-4-(hexadecyloxycarbonyloxy)benzoate (20 mg)
Sodium 3,5-bis[3-(2,4-di-t-amylphenoxy)propylcarbamoyl]benzenesulfinate (20 mg)
Green-sensitive silver chlorobromide emulsion (150 mg)
Second Gelatine Interlayer
Gelatine (1000 mg)
5-Chloro-2-(3,5-di-t-butyl-2-hydroxyphenyl)benz-1,2,3-triazole (200 mg)
2-(3-Dodecyl-2-hydroxy-5-methylphenyl)benz-1,2,3-triazole (200 mg)
Trinonyl phosphate (300 mg)
2,5-Di-t-octylhydroquinone (50 mg)
Hexyl 5-[2,5-dihydroxy-4-(4-hexyloxycarbonyl-1,1-dimethylbutyl)phenyl]-5-methylhexanoate (50 mg)
Red-Sensitive Layer
2-[α-(2,4-Di-t-amylphenoxy)butanamido]-4,6-dichloro-5-ethylphenol (150 mg)
2,4-Dichloro-3-ethyl-6-hexadecanamidophenol (150 mg)
4-Chloro-2-(1,2,3,4,5-pentafluorobenzamido)-5-[2-(2,4-di-t-amylphenoxy)-3-methylbutanamido]phenol (100 mg)
Dioctyl phthalate (100 mg)
Dicyclohexyl phthalate (100 mg)
Gelatine (1200 mg)
5-Chloro-2-(3,5-di-t-butyl-2-hydroxyphenyl)benz-1,2,3-triazole (100 mg)
2-(3-Dodecyl-2-hydroxy-5-methylphenyl)benz-1,2,3-triazole (100 mg) 2,4-Di-t-amylphenyl 3,5-di-t-butyl-4-hydroxybenzoate (50 mg)
Poly(N-t-butylacrylamide) (300 mg)
N,N-Diethyl-2,4-di-t-amylphenoxyacetamide (100 mg)
2,5-Di-t-octylhydroquinone (50 mg)
Red-sensitive silver chlorobromide emulsion (200 mg)

The top layer is produced with and without UV absorber; with UV absorber:
2,5-Di-t-octylhydroquinone (20 mg)
Hexyl 5-[2,5-dihydroxy-4-(4-hexyloxycarbonyl-1,1-dimethylbutyl)phenyl]-5-methylhexanoate (20 mg)
Gelatine (400 mg)
Trinonyl phosphate (120 mg)
UV absorber Comp. No. (II) (200 mg)
without UV absorber
Gelatine (800 mg)

The hardener used is a solution of the potassium salt of 2,4-dichloro-6-hydroxytriazine, and the wetting agent used is the sodium salt of diisobutylnaphthalenesulfonic acid.

Three step wedges having a density difference of 0.3 log E per step are exposed onto each of the samples (with blue, green and red light). The samples are then processed by the (Kodak) RA-4 process for colour papers.

After exposure and processing, the remission densities are measured in red for the cyan step, in green for the magenta step and in blue for the yellow step at a wedge density of between 0.9 and 1.1. The wedges are then exposed in an atlas exposure unit with a total of 15 kJ/cm$^2$, and the remission densities are remeasured.

The remission density of the magenta wedge is also measured in the blue before and after exposure for yellowing.

The presence of the UV absorber reduces the reduction in colour density of the cyan, magenta and yellow image dyes.

EXAMPLE 29

UV filter layers are produced as described in Example 27. The samples are exposed in an atlas exposure unit with 120 kJ/cm$^2$, and the drop in density is determined at the long-wave absorption maximum ($I_{max}$). The results are shown in the table below.

| Sample | Novel UVA | Conventional UVA | Weight ratio | Drop in density |
|---|---|---|---|---|
| 29-1 | none | HPT-10 | — | 6.1% |
| 29-2 | Comp. I | HPT-10 | 5/95 | 5.7% |
| 29-3 | Comp. I | HPT-10 | 10/90 | 5.1% |
| 29-4 | Comp. I | HPT-10 | 20/80 | 4.8% |
| 29-5 | Comp. III | HPT-10 | 5/95 | 6.0% |
| 29-6 | Comp. III | HPT-10 | 10/90 | 5.6% |
| 29-7 | Comp. III | HPT-10 | 20/80 | 4.2% |
| 29-8 | none | HPT-26b | — | 6.0% |
| 29-9 | Comp. I | HPT-26b | 5/95 | 5.7% |
| 29-10 | Comp. I | HPT-26b | 10/90 | 5.7% |
| 29-11 | Comp. I | HPT-26b | 20/80 | 5.3% |
| 29-12 | Comp. III | HPT-26b | 5/95 | 5.6% |
| 29-13 | Comp. III | HPT-26b | 10/90 | 5.4% |
| 29-14 | Comp. III | HPT-26b | 20/80 | 4.5% |
| 29-15 | none | HBT-10 | — | 22% |
| 29-16 | Comp. XIV | HBT-10 | 10/90 | 20% |
| 29-17 | Comp. XIV | HBT-10 | 12/88 | 19.6% |
| 29-18 | Comp. XIV | HBT-10 | 25/75 | 16.4% |
| 29-19 | none | HBT-7 | — | 9.6% |
| 29-20 | Comp. XIV | HBT-7 | 33/66 | 7.5% |
| 29-21 | Comp. XIV | HBT-7 | 25/75 | 6.4% |

EXAMPLE 30

Chromogenic layers produced as described in Example 26 are exposed in an atlas exposure unit behind UV filters produced as described in Example 27. The remission density is measured before and after exposure (in the green region for magenta layers anad in the blue region for yellow layers). The results are shown in the table below. The comparisons used are samples with filter layers containing no UVA (–) and samples as per Example 29 containing a conventional UVA (*).

| Coupler from Example | UV filter from Example | Exposure with | Drop in density |
|---|---|---|---|
| 26-1 | — | 7,5 kJ/cm$^2$ | 49% |
| 26-1 | 29-1* | 7,5 kJ/cm$^2$ | 28% |
| 26-1 | 29-2 | 7,5 kJ/cm$^2$ | 25% |
| 26-1 | 29-3 | 7,5 kJ/cm$^2$ | 25% |
| 26-1 | 29-4 | 7,5 kJ/cm$^2$ | 25% |
| 26-1 | 29-5 | 7,5 kJ/cm$^2$ | 23% |
| 26-1 | 29-6 | 7,5 kJ/cm$^2$ | 23% |
| 26-1 | 29-7 | 7,5 kJ/cm$^2$ | 25% |
| 26-2 | — | 45 kJ/cm$^2$ | 93% |
| 26-2 | 29-1* | 45 kJ/cm$^2$ | 59% |
| 26-2 | 29-2 | 45 kJ/cm$^2$ | 53% |
| 26-2 | 29-9 | 45 kJ/cm$^2$ | 49% |
| 26-2 | 29-10 | 45 kJ/cm$^2$ | 48% |
| 26-2 | 29-11 | 45 kJ/cm$^2$ | 46% |
| 26-2 | 29-12 | 45 kJ/cm$^2$ | 47% |
| 26-2 | 29-19* | 45 kJ/cm$^2$ | 64% |
| 26-2 | 29-20 | 45 kJ/cm$^2$ | % |
| 26-2 | 29-21 | 45 kJ/cm$^2$ | % |
| 26-3 | — | 15 kJ/cm$^2$ | 69% |

-continued

| Coupler from Example | UV filter from Example | Exposure with | Drop in density |
|---|---|---|---|
| 26-3 | 29-1* | 15 kJ/cm$^2$ | 41% |
| 26-3 | 29-2 | 15 kJ/cm$^2$ | 38% |
| 26-3 | 29-9 | 15 kJ/cm$^2$ | 35% |
| 26-3 | 29-12 | 15 kJ/cm$^2$ | 34% |
| 26-3 | 29-13 | 15 kJ/cm$^2$ | 36% |
| 26-3 | 29-14 | 15 kJ/cm$^2$ | 35% |

Filter layers which include the novel stabilizer of the formula (1) protect the dye significantly better than filter layers containing no UVA (–) or containing a conventional UVA (*).

What is claimed is:

1. Photographic recording material comprising, on a base, a blue-sensitive silver-halide emulsion layer, a green-sensitive silver-halide emulsion layer and/or a red-sensitive silver-halide emulsion layer, a protection layer above the sensitive layers, and, if desired, layers between the sensitive layers, where a layer includes a compound of the formula (1)

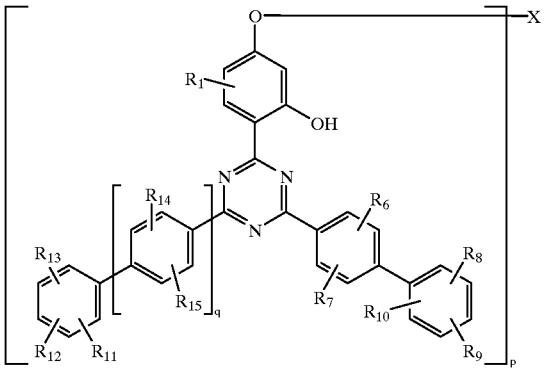

or (1a)

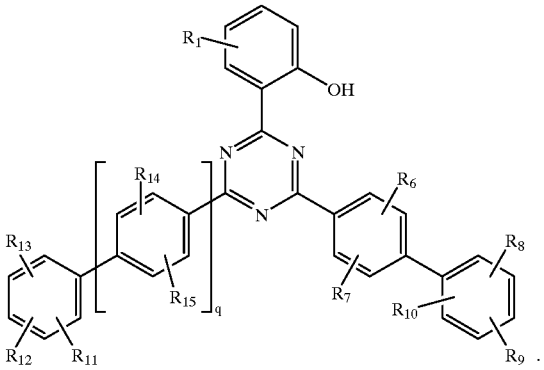

in which $R_1$ is hydrogen; $C_1$–$C_{24}$alkyl or $C_5$–$C_{12}$cycloalkyl; or $C_1$–$C_{24}$alkyl or $C_5$–$C_{12}$cycloalkyl which is substituted by 1 to 9 halogen atoms, —$R_4$, —$OR_5$, —$N(R_5)_2$, =$NR_5$, =O, —$CON(R_5)_2$, —$COR_5$, —$COOR_5$, —$OCOR_5$, —$OCON(R_5)_2$, —CN, —$NO_2$, —$SR_5$, —$SOR_5$, —$SO_2R_5$, —$P(O)(OR_5)_2$, a morpholinyl, piperidinyl, 2,2,6,6-tetramethylpiperidinyl, piperazinyl or N-methylpiperazinyl group, or a combination thereof; or $C_1$–$C_{24}$alkyl or $C_5$–$C_{12}$cycloalkyl which is interrupted by 1 to 6 phenylene, —O—, —$NR_5$—, —$CONR_5$—, —COO—, —OCO—, —$CH(R_5)$—, —$C(R_5)_2$— or —CO— groups, or a combination thereof; or $R_1$ is $C_2$–$C_{24}$alkenyl; halogen; —$SR_3$, $SOR_3$; $SO_2R_3$; —$SO_3H$; or $SO_3M$;

$R_3$ is $C_1$–$C_{20}$alkyl; $C_3$–$C_{18}$alkenyl; $C_5$–$C_{12}$cycloalkyl; $C_7$–$C_{15}$phenylalkyl, or $C_6$–$C_{12}$aryl which is unsubstituted or substituted by 1 to 3 $C_1$–$C_4$alkyl groups;

$R_4$ is unsubstituted $C_6$–$C_{12}$aryl; $C_6$–$C_{12}$aryl which is substituted by 1 to 3 halogen atoms, $C_1$-$C_8$alkyl or $C_1$–$C_8$alkoxy, or a combination thereof; $C_5$–$C_{12}$cycloalkyl; unsubstituted $C_7$-$C_{15}$phenylalkyl; $C_7$–$C_{15}$phenylalkyl which is substituted on the phenyl ring by 1 to 3 halogen atoms, $C_1$–$C_8$alkyl or $C_1$–$C_8$alkoxy, or a combination thereof; or $C_2$–$C_8$alkenyl;

$R_5$ is $R_4$; hydrogen; $C_1$–$C_{24}$alkyl; or a radical of the formula

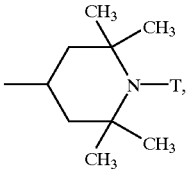

in which

T is hydrogen; $C_1$–$C_8$alkyl; $C_2$–$C_8$alkyl which is substituted by hydroxyl or acyloxy; oxygen; hydroxyl; —$CH_2CN$; $C_1$-$C_{18}$alkoxy; $C_5$–$C_{12}$cycloalkoxy; $C_3$–$C_6$alkenyl; $C_7$–$C_9$phenylalkyl; $C_7$–$C_9$phenylalkyl which is monosubstituted, disubstituted or trisubstituted on the phenyl ring by $C_1$–$C_4$alkyl; or aliphatic $C_1$–$C_8$alkanoyl;

$R_6$ to $R_{15}$, independently of one another, are hydrogen; hydroxyl; —C≡N; $C_1$-$C_{20}$alkyl; $C_1$–$C_{20}$alkoxy; $C_7$–$C_{20}$phenylalkyl; $C_4$–$C_{12}$cycloalkyl; $C_4$–$C_{12}$cycloalkoxy; halogen; halo-$C_1$–$C_5$alkyl; sulfonyl; carboxyl; acylamino; acyloxy; $C_1$–$C_{12}$alkoxycarbonyl; aminocarbonyl; —O—Y; or O—Z; or $R_8$ and $R_9$, together with the phenyl radical, form a cyclic radical which is interrupted by oxygen or nitrogen; and $R_{11}$, in the case where q is 0, additionally comprises —$NG_{16}G_{17}$, where $G_{16}$ is hydrogen or $C_1$–$C_{20}$alkyl;

$G_{17}$ is hydrogen, $C_1$–$C_{20}$alkyl, $C_7$–$C_{13}$phenylalkyl, —C(=O)—$G_{19}$, —C(=O)—NH—$G_{16}$; and $G_{19}$ is $C_1$–$C_{20}$alkyl; $C_2$–$C_{20}$alkyl which is interrupted by 1 to 6 oxygen atoms and/or is substituted by OH, halogen, $NH_2$, $NHG_9$ or $NG_9G_{10}$; $C_1$–$C_{20}$alkoxy; phenyl; $C_7$–$C_{13}$phenylalkyl or $C_2$–$C_{20}$alkenyl; where $G_9$ and $G_{10}$ are as $R_5$ defined above;

M is an alkali metal;

p is 1 or 2; q is 0 or 1;

and, in the case where p=1,

X, Y and Z, independently of one another, are $R_y$; $R_x$-substituted $C_1$–$C_{24}$alkyl; $C_2$–$C_{50}$alkyl which is interrupted by oxygen and substituted by OH and/or $R_x$; $R_x$-substituted $C_4$–$C_{12}$cycloalkyl; $R_yO$-substituted $C_4$–$C_{12}$cycloalkyl; $C_4$–$C_{20}$alkenyl which is interrupted by oxygen; or a radical of the formula —$CH((CH_2)_n$—$R_2)$—CO—O—$(CH_2)_m$—$R'_2$; —$CH((CH_2)_n$—$R_2)$—CO—(NR')—$(CH_2)_m$—$R'_2$;

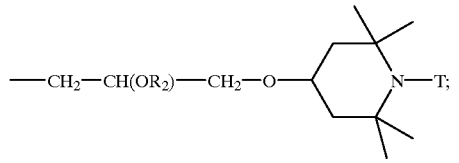

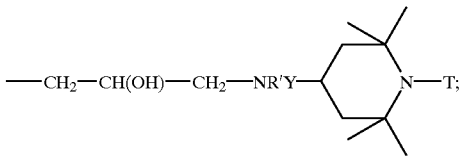

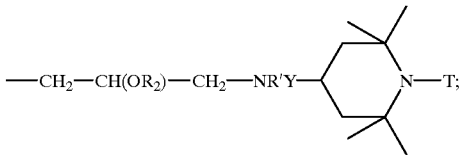

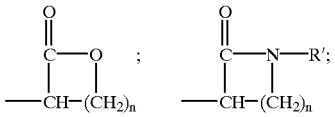

—CO—$(CH_2)_n$—$R_2$; —CO—O—$(CH_2)_n$—$R_2$; —$CH_2$—CH(—O—(CO)—$R_2$)—$R'_2$; or —CO—NR'—$(CH_2)_n$—$R_2$;

$R_2$ and $R'_2$, independently of one another, are $R_x$ if bonded to a carbon atom or $R_y$ if bonded to an atom other than carbon;

n is a number from 0 to 20; and m is a number from 0 to 20; and, in the case where p=2, Y and Z, independently of one another, are as defined for p=1; and X is $C_2$–$C_{12}$alkylene; —CO—($C_2$–$C_{12}$alkylene)-CO—; —CO-phenylene-CO—; CO-biphenylene-CO—; CO—O—($C_2$–$C_{12}$alkylene)-O—CO—; —CO—O-phenylene-O—CO—; —CO—O-biphenylene-O—CO—; —CO—NR'—($C_2$–$C_{12}$alkylene)-NR'—CO—; —CO—NR'-phenylene-NR'—CO—; —CO—NR'-biphenylene-NR'—CO—; —$CH_2$—CH(OH)—$CH_2$—; —$CH_2$—CH($OR_2$)—$CH_2$—; —$CH_2$—CH(OH)—$CH_2$—O—D—O—$CH_2$—CH(OH)—$CH_2$; —CH($(CH_2)_nR_2$)—COO—D—OOC—CH($(CH_2)_nR_2$)—; or —$CH_2$—CH($OR_2$)—$CH_2$—O—D—O—$CH_2$—CH($OR_2$)—$CH_2$—;

D is $C_2$–$C_{12}$alkylene; $C_4$–$C_{50}$alkylene which is interrupted by oxygen; phenylene; biphenylene or phenylene-E-phenylene;

E is —O—; —S—; —$SO_2$—; —$CH_2$—; —CO—; or —$C(CH_3)_2$—;

$R_x$ is hydrogen; hydroxyl; $C_1$–$C_{20}$alkyl; $C_4$–$C_{12}$cycloalkyl; $C_1$–$C_{20}$alkoxy; $C_4$–$C_{12}$cycloalkoxy; $C_4$–$C_{12}$cycloalkyl or $C_4$–$C_{12}$cycloalkyloxy which is interrupted by oxygen; $C_6$–$C_{12}$aryl; hetero-$C_3$–$C_{12}$aryl; —$OR_z$; $NHR_z$; $R_z$; CONR'R"; allyl; $C_2$–$C_{20}$alkenyl; $C_4$–$C_{12}$cycloalkenyl; $C_4$–$C_{12}$cycloalkenyl which is interrupted by oxygen; $C_3$–$C_{20}$alkynyl; $C_6$–$C_{12}$cycloalkynyl; or $C_1$–$C_{20}$alkyl, $C_2$–$C_{20}$alkoxy or $C_4$–$C_{12}$cycloalkyl, each of which is substituted by hydroxyl, —$NH_2$, —NH—$C_1$–$C_8$alkyl, —NH-cyclohexyl, —N($C_1$–$C_8$alkyl)$_2$, dicyclohexylamino, halogen, $C_1$–$C_{20}$alkyl, $C_1$–$C_{20}$alkoxy, $C_4$–$C_{12}$cycloalkyl, $C_4$–$C_{12}$cycloalkoxy, $C_2$–$C_{20}$alkenyl, $C_4$–$C_{12}$cycloalkyl, $C_3$–$C_{20}$alkynyl, $C_6$–$C_{12}$cycloalkynyl, $C_6$–$C_{12}$aryl, acylamino, acyloxy, sulfonyl, carboxyl, (meth)acryloxy, (meth)acrylamino,

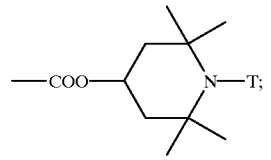

or

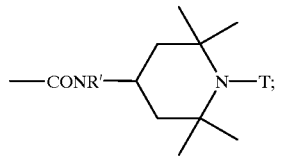

$R_y$ is hydrogen; $C_1$–$C_{20}$alkyl; $C_4$–$C_{12}$cycloalkyl; $C_4$–$C_{12}$cycloalkyl which is interrupted by oxygen; $C_6$–$C_{12}$aryl; hetero-$C_3$–$C_{12}$aryl; $R_z$; allyl; $C_2$–$C_{20}$alkenyl; $C_4$–$C_{12}$cycloalkenyl which is uninterrupted or interrupted by oxygen; $C_3$–$C_{20}$alkynyl; $C_6$–$C_{12}$cycloalkynyl; or $C_1$–$C_{20}$alkyl or $C_4$–$C_{12}$cycloalkyl, each of which is substituted by hydroxyl, —$NH_2$, —NH—$C_1$–$C_8$alkyl, —NH-cyclohexyl, —N($C_1$–$C_8$alkyl)$_2$, dicyclohexylamino, halogen, $C_1$–$C_{20}$alkyl, $C_1$–$C_{20}$alkoxy, $C_4$–$C_{12}$cycloalkyl, $C_4$–$C_{12}$cycloalkoxy, $C_2$–$C_{20}$alkenyl, $C_4$–$C_{12}$cycloalkenyl, $C_3$–$C_{20}$alkynyl, $C_6$–$C_{12}$cycloalkynyl, $C_6$–$C_{12}$aryl, acylamino, acyloxy, sulfonyl, carboxyl, (meth)acryloxy, (meth)acrylamino,

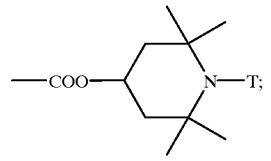

or

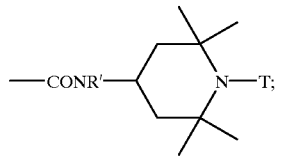

$R_z$ is —COR'; —COOR'; —CONR'R"; —CO—CH=$CH_2$; or —CO—C($CH_3$)=$CH_2$;

R' and R", independently of one another, are hydrogen; $C_1$–$C_{20}$alkyl; $C_4$–$C_{50}$alkyl which is interrupted by oxygen; $C_4$–$C_{12}$cycloalkyl; $C_4$–$C_{12}$cycloalkyl which is interrupted by oxygen; $C_2$–$C_{20}$alkenyl; $C_4$–$C_{20}$alkenyl which is interrupted by oxygen; $C_6$–$C_{12}$aryl; or $C_1$–$C_{20}$alkyl or $C_4$–$C_{12}$cycloalkyl each of which is substituted by hydroxyl, —$NH_2$, —NH—$C_1$–$C_8$alkyl, —NH-cyclohexyl, —N($C_1$–$C_8$alkyl)$_2$, dicyclohexylamino, halogen, $C_1$–$C_{20}$alkyl, $C_1$–$C_{20}$alkoxy, $C_4$–$C_{12}$cycloalkyl, $C_4$–$C_{12}$cycloalkoxy, $C_2$–$C_{20}$alkenyl, $C_4$–$C_{12}$cycloalkenyl, $C_3$–$C_{20}$alkynyl, $C_6$–$C_{12}$cycloalkynyl, $C_6$–$C_{12}$aryl, acylamino, acyloxy, sulfonyl, carboxyl, (meth)acryloxy, (meth)acrylamino,

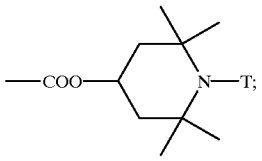

or

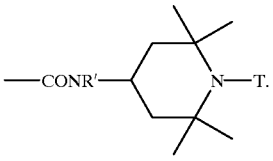

2. Photographic recording material according to claim 1 comprising, on a base, a blue-sensitive silver-halide emulsion layer, a green-sensitive silver-halide emulsion layer and/or a red-sensitive silver-halide emulsion layer, a protection layer above the sensitive layers, and, if desired, layers between the sensitive layers, where a layer includes a compound of the formula (1)

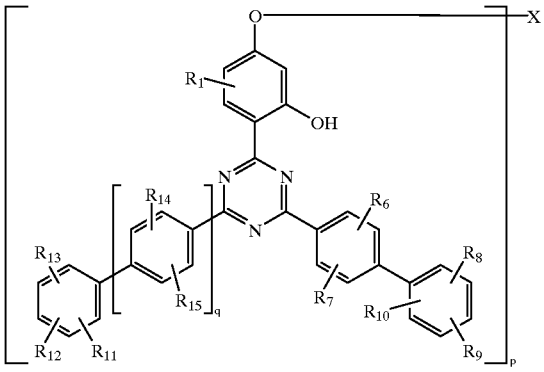

or (1a)

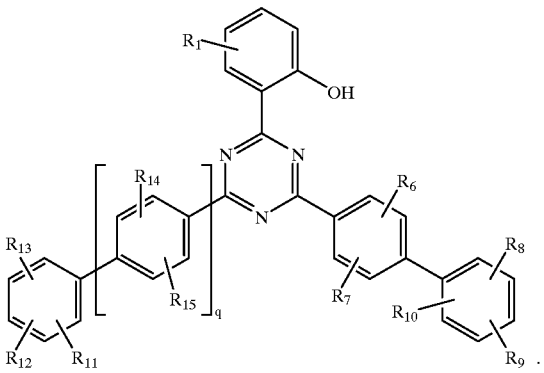

in which $R_1$ is hydrogen; $C_1$–$C_{24}$alkyl or $C_5$–$C_{12}$cycloalkyl; or $C_1$–$C_{24}$alkyl or $C_5$–$C_{12}$cycloalkyl which is substituted by 1 to 9 halogen atoms, —$R_4$, —$OR_5$, —N($R_5$)$_2$, =$NR_5$, =O, —CON($R_5$)$_2$, —$COR_5$, —$COOR_5$, —$OCOR_5$, —OCON($R_5$)$_2$, —CN, —$NO_2$, —$SR_5$, —$SOR_5$, —$SO_2R_5$, —P(O)($OR_5$)$_2$, a morpholinyl, piperidinyl, 2,2,6,6-tetramethylpiperidinyl, piperazinyl or N-methylpiperazinyl group, or a combination thereof; or $C_1$–$C_{24}$alkyl or $C_5$–$C_{12}$cycloalkyl which is interrupted by 1 to 6 phenylene, —O—, —$NR_5$—, —$CONR_5$—, —COO—, —OCO—, —CH($R_5$)—, —C($R_5$)$_2$— or —CO— groups, or a combination thereof; or $R_1$ is $C_2$–$C_{24}$alkenyl; halogen; —$SR_3$, $SOR_3$; $SO_2R_3$; —$SO_3H$;

—$SO_3M$; or a radical of the formula

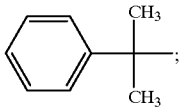

$R_3$ is $C_1$–$C_{20}$alkyl; $C_3$–$C_{18}$alkenyl; $C_5$–$C_{12}$cycloalkyl; $C_7$–$C_{15}$phenylalkyl, or $C_6$–$C_{12}$aryl which is unsubstituted or substituted by 1 to 3 $C_1$–$C_4$alkyl groups;

$R_4$ is unsubstituted $C_6$–$C_{12}$aryl; $C_6$–$C_{12}$aryl which is substituted by 1 to 3 halogen atoms, $C_1$-$C_8$alkyl or $C_1$–$C_8$alkoxy, or a combination thereof; $C_5$–$C_{12}$cycloalkyl; unsubstituted $C_7$-$C_{15}$phenylalkyl; $C_7$–$C_{15}$phenylalkyl which is substituted on the phenyl ring by 1 to 3 halogen atoms, $C_1$–$C_8$alkyl or $C_1$–$C_8$alkoxy, or a combination thereof; or $C_2$–$C_8$alkenyl;

$R_5$ is $R_4$; hydrogen; $C_1$–$C_{24}$alkyl; or a radical of the formula

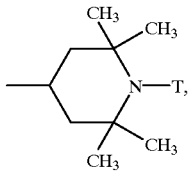

in which

T is hydrogen; $C_1$–$C_8$alkyl; $C_2$–$C_8$alkyl which is substituted by hydroxyl or acyloxy; oxygen; hydroxyl; —$CH_2CN$; $C_1$–$C_{18}$alkoxy; $C_5$–$C_{12}$cycloalkoxy; $C_3$–$C_6$alkenyl; $C_7$–$C_9$phenylalkyl; $C_7$–$C_9$phenylalkyl which is monosubstituted, disubstituted or trisubstituted on the phenyl ring by $C_1$–$C_4$alkyl; or aliphatic $C_1$–$C_8$alkanoyl;

$R_6$ to $R_{15}$, independently of one another, are hydrogen; hydroxyl; —C≡N; $C_1$–$C_{20}$alkyl; $C_1$–$C_{20}$alkoxy; $C_7$–$C_{20}$phenylalkyl; $C_4$–$C_{12}$cycloalkyl; $C_4$–$C_{12}$cycloalkoxy; halogen; halo-$C_1$–$C_5$alkyl; sulfonyl; carboxyl; acylamino; acyloxy; $C_1$–$C_{12}$alkoxycarbonyl; aminocarbonyl; —O—Y; or O—Z; or $R_8$ and $R_9$, together with the phenyl radical, form a cyclic radical which is interrupted by oxygen or nitrogen;

M is an alkali metal;

p is 1 or 2;

q is 0 or 1;

and, in the case where p=1,

X, Y and Z, independently of one another, are hydrogen; $R_y$; $R_2$-substituted $C_1$–$C_{24}$alkyl; $C_2$–$C_{50}$alkyl which is interrupted by oxygen and substituted by OH and/or $R_2$; $R_2$-substituted $C_4$–$C_{12}$cycloalkyl; $R_2O$-substituted $C_4$–$C_{12}$cycloalkyl; $C_4$–$C_{20}$alkenyl which is interrupted by oxygen; or a radical of the formula —CH((CH$_2$)$_n$—R$_2$)—CO—O—(CH$_2$)$_m$—R'$_2$; —CH((CH$_2$)$_n$—R$_2$)—CO—(NR')—(CH$_2$)$_m$—R'$_2$;

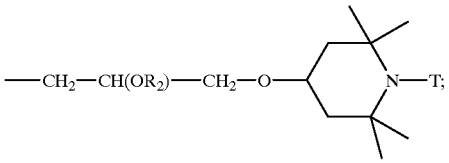

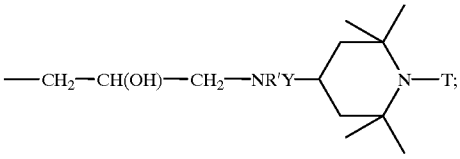

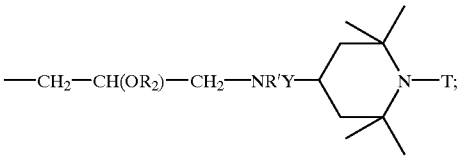

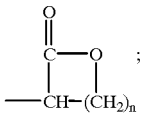

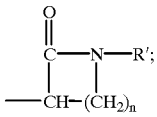

—CO—(CH$_2$)$_n$—R$_2$; —CO—O—(CH$_2$)$_n$—R$_2$; —CH$_2$—CH(—O—(CO)—R$_2$)—R'$_2$; or —CO—NR'—(CH$_2$)$_n$—R$_2$;

$R_2$ and $R'_2$, independently of one another, are $R_x$ if bonded to a carbon atom or $R_y$ if bonded to an atom other than carbon;

n is from 0 to 20; and m is from 0 to 20; and, in the case where p=2,

Y and Z, independently of one another, are as defined for p=1; and

X is $C_2$–$C_{12}$alkylene; —CO—($C_2$–$C_{12}$alkylene)-CO—; —CO-phenylene-CO—; CO-biphenylene-CO—; CO—O—($C_2$–$C_{12}$alkylene)-O—CO—; —CO—O-phenylene-O—CO—; —CO—O-biphenylene-O—CO—; —CO—NR'—($C_2$–$C_{12}$alkylene)-NR'—CO—; —CO—NR'-phenylene-NR'—CO—; —CO—NR'-biphenylene-NR'—CO—; —CH$_2$—CH(OH)—CH$_2$—; —CH$_2$—CH(OR$_2$—CH$_2$—; —CH$_2$—CH(OH)—CH$_2$—O—D—O—CH$_2$—CH(OH)—CH$_2$; or —CH$_2$—CH(OR$_2$)—CH$_2$—O—D—O—CH$_2$—CH(OR$_2$)—CH$_2$—;

D is $C_2$–$C_{12}$alkylene; $C_4$–$C_{50}$alkylene which is interrupted by oxygen; phenylene; biphenylene or phenylene-E-phenylene;

E is —O—; —S—; —SO$_2$—; —CH$_2$—; —CO—; or —C(CH$_3$)$_2$—;

$R_x$ is hydrogen; hydroxyl; $C_1$–$C_{20}$alkyl; $C_4$–$C_{12}$cycloalkyl; $C_1$–$C_{20}$alkoxy; $C_4$–$C_{12}$cycloalkoxy; $C_4$–$C_{12}$cycloalkyl or $C_4$–$C_{12}$cycloalkyloxy which is interrupted by oxygen; $C_6$–$C_{12}$aryl; hetero-$C_3$–$C_{12}$aryl; —OR$_z$; NHR$_z$; R$_z$; CONR'R"; allyl; $C_2$–$C_{20}$alkenyl; $C_4$–$C_{12}$cycloalkenyl; $C_4$–$C_{12}$cycloalkenyl which is interrupted by one or more oxygen atoms; $C_3$–$C_{20}$alkynyl; or $C_6$–$C_{12}$cycloalkynyl;

$R_y$ is hydrogen; $C_1$–$C_{20}$alkyl; $C_4$–$C_{12}$cycloalkyl; $C_4$–$C_{12}$cycloalkyl which is interrupted by oxygen; $C_6$–$C_{12}$aryl; hetero-$C_3$–$C_{12}$aryl; R$_z$; allyl; $C_2$–$C_{20}$alkenyl; $C_4$–$C_{12}$cycloalkenyl which is uninterrupted or interrupted by oxygen; $C_3$–$C_{20}$alkynyl; or $C_6$–$C_{12}$cycloalkynyl;

$R_z$ is —COR'; —COOR'; —CONR'R"; —CO—CH═CH$_2$; or —CO—C(CH$_3$)═CH$_2$; and

R' and R", independently of one another, are hydrogen; $C_1$–$C_{20}$alkyl; $C_4$–$C_{50}$alkyl which is interrupted by oxygen; $C_4$–$C_{12}$cycloalkyl; $C_4$–$C_{12}$cycloalkyl which is interrupted by oxygen; $C_2$–$C_{20}$alkenyl; $C_2$–$C_{20}$alkenyl which is interrupted by oxygen; or $C_6$-$C_{12}$aryl.

3. A photographic recording material according to claim 1, which includes a compound of the formula (1) or (1a) in which $R_1$ is hydrogen; $C_1$–$C_{24}$alkyl, $C_5$–$C_{12}$cycloalkyl or $C_7$–$C_{15}$phenylalkyl;

$R_6$ to $R_{15}$, independently of one another, are H; $C_1$–$C_{12}$alkyl, $C_2$–$C_6$alkenyl, Cl, F, OY, or OZ;

p is 1; and q is 0 or 1;

X, Y and Z, independently of one another, are $R_y$; $R_x$-substituted $C_1$–$C_{24}$alkyl; $C_2$–$C_{50}$alkyl which is interrupted by oxygen and substituted by OH and/or $R_x$; or a radical of the formula —CH((CH$_2$)$_n$—R$_2$)—CO—O—(CH$_2$)$_m$—R'$_2$; —CH((CH$_2$)$_n$—R$_2$)—CO—(NR')—(CH$_2$)$_m$—R'$_2$; —CO—(CH$_2$)$_n$—R$_2$; —CO—O—(CH$_2$)$_n$—R$_2$; —CH$_2$—CH(—O—(CO)—R$_2$)—R'$_2$; or —CO—NR'—(CH$_2$)$_n$—R$_2$;

$R_2$ and $R'_2$, independently of one another, are $R_x$ if bonded to a carbon atom and $R_y$ if bonded to an atom other than carbon;

n is from 0 to 20; and m is from 0 to 20; and $R_x$ is hydrogen; hydroxyl; $C_1$–$C_{20}$alkyl; $C_4$–$C_{12}$cycloalkyl; $C_1$–$C_{20}$alkoxy; $C_6$–$C_{12}$cycloalkoxy; phenyl; —OR$_z$; NHR$_z$; R$_z$; allyl; or $C_1$–$C_{20}$alkyl, $C_2$–$C_{20}$alkoxy or $C_4$–$C_{12}$cycloalkyl each of which is substituted by hydroxyl, $C_1$–$C_{20}$alkyl, $C_1$–$C_{20}$alkoxy, acyloxy, carboxyl or (meth)acryloxy;

$R_y$ is hydrogen; $C_1$–$C_{20}$alkyl; $C_4$–$C_{12}$cycloalkyl; phenyl; R$_z$; allyl; or $C_1$–$C_{20}$alkyl or $C_4$–$C_{12}$cycloalkyl each of which is substituted by hydroxyl, $C_1$–$C_{20}$alkyl, $C_1$–$C_{20}$alkoxy, acyloxy, carboxyl or (meth)acryloxy;

$R_z$ is —COR'; —COOR'; —CONR'R"; —CO—CH═CH$_2$; or —CO—C(CH$_3$)═CH$_2$;

R' and R" independently of one another, are hydrogen; $C_1$–$C_{20}$alkyl; $C_4$–$C_{20}$alkyl which is interrupted by oxygen; $C_4$–$C_{12}$cycloalkyl; $C_2$–$C_3$alkenyl; phenyl; or $C_1$-$C_{20}$alkyl or cyclohexyl each of which is substituted by hydroxyl, $C_1$–$C_{12}$alkyl, $C_1$–$C_{12}$alkoxy or carboxyl.

4. A photographic recording material according to claim 1, which includes a compound of the formula (1) or (1a) in which $R_6$ to $R_{15}$, independently of one another, are H, $C_1$–$C_{12}$alkyl or Cl, and $R_{11}$, $R_{12}$ and $R_{13}$, in the case where q is 0, may alternatively be OH or OY;

p is 1;

X and Y, independently of one another, are $R_y$; $R_x$-substituted $C_2$–$C_{12}$alkyl; or $C_3$–$C_{30}$alkyl which is interrupted by oxygen and substituted by OH and/or $R_x$;

$R_x$ is hydroxyl; $C_1$–$C_{12}$alkyl; $C_6$–$C_{12}$cycloalkyl; $C_1$–$C_{20}$alkoxy; $C_6$–$C_{12}$cycloalkoxy; phenyl; —$OR_z$;

$R_z$; allyl; or $C_1$–$C_{20}$alkyl, $C_2$–$C_{20}$alkoxy or cyclohexyl, which is substituted by hydroxyl, $C_1$-$C_{12}$alkyl, $C_1$–$C_{12}$alkoxy or carboxyl;

$R_y$ is hydrogen; $C_1$–$C_{12}$alkyl; $C_6$–$C_{12}$cycloalkyl; phenyl; $R_z$; allyl; or $C_1$–$C_{20}$alkyl or cyclohexyl, each of which is substituted by hydroxyl, $C_1$–$C_{12}$alkyl, $C_1$–$C_{12}$alkoxy or carboxyl;

$R_z$ is —COR'; —COOR'; —CONR'R"; —CO—CH=$CH_2$; or —CO—C($CH_3$)=$CH_2$;

R' and R", independently of one another, are hydrogen; $C_1$–$C_{20}$alkyl; $C_4$–$C_{20}$alkyl which is interrupted by oxygen; $C_4$–$C_{12}$cycloalkyl; or $C_2$–$C_{20}$alkyl or cyclohexyl each of which is substituted by hydroxyl, $C_1$–$C_{12}$alkyl, $C_1$–$C_{12}$alkoxy or carboxyl.

5. A photographic recording material according to claim 1, which includes a compound of the formula (1) or (1a) in which p and q are each 1, and $R_1$ and $R_6$ to $R_{15}$ are hydrogen.

6. A photographic recording material according to claim 1, which includes a compound of the formula (1) or (1a) in which $R_6$ to $R_{15}$ are H;

q is 1;

p is 1;

X and Y, independently of one another, are $R_y$; $R_x$-substituted $C_2$–$C_{12}$alkyl; or $C_3$–$C_{30}$alkyl which is interrupted by oxygen and substituted by OH and/or $R_x$;

$R_x$ is hydroxyl; $C_1$–$C_{20}$alkoxy; cyclohexyloxy; —$OR_z$; $R_z$; or allyl;

$R_y$ is hydrogen; $C_1$–$C_{20}$alkyl; or cyclohexyl;

$R_z$ is —COR'; or —COOR';

R' is hydrogen; $C_1$–$C_{20}$alkyl; $C_4$–$C_{20}$alkyl which is interrupted by oxygen; cyclohexyl or $C_1$–$C_4$alkylcyclohexyl.

7. A photographic recording material according to claim 1, which includes a compound of the formula (1) or (1a) in a layer above the silver-halide emulsion layer(s).

8. A photographic recording material according to claim 1, which comprises, on a support, a red-sensitive and a green-sensitive silver-halide emulsion layer, separated by an interlayer which includes a compound of the formula (1) or (1a).

9. A photographic recording material according to claim 1, comprising, on a support, a red-sensitive, a green-sensitive and a blue-sensitive silver-halide emulsion layer and interlayers between said layers, and a protection layer, where a compound of the formula (1) or (1a) is present in a layer above the green-sensitive layer, and the silver-halide emulsion layers include a dark-storage stabilizer and/or a light stabilizer.

10. A photographic recording material according to claim 1, wherein the compound of formula (1) or (1a) is present in an amount of from 0.001 to 10 g/$m^2$.

11. A photographic recording material according to claim 1, wherein a layer additionally includes a further UV absorber from the 2-(2-hydroxyphenyl)benzotriazole and/or 2-(2-hydroxyphenyl)-1,3,5-triazine class.

12. A photographic recording material according to claim 11, wherein the further UV absorber conforms to the formula AII (AII)

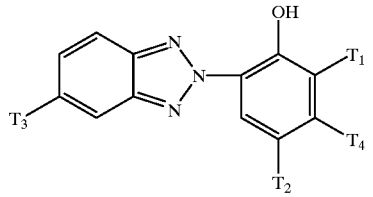

in which $T_1$ and $T_2$, independently of one another, are hydrogen, halogen, alkyl, alkyl which is substituted by $COOT_5$, alkoxy, aryloxy, hydroxyl, aralkyl, aryl or acyloxy, where $T_5$ is alkyl or alkyl which is interrupted by O, $T_3$ is hydrogen, halogen, alkyl, alkoxy, aryloxy, acyloxy, —$CF_3$, phenyl, —S—$T_6$ or —$SO_2$—$T_6$; and $T_4$ is hydrogen, hydroxyl, alkoxy, aryloxy or acyloxy or a group of one of the formulae —$OCH_2CH(OT_8)$—$CH_2$—O—$T_7$ and —$OCH_2CH_2$—O—CO—$T_7$;

$T_6$ is alkyl or aryl;

$T_7$ is alkyl or aryl;

$T_8$ is hydrogen or CO—$T_9$;

$T_9$ is alkyl or alkenyl.

13. A photographic recording material according to claim 11, wherein the further UV absorber conforms to one of the formulae (AIII)

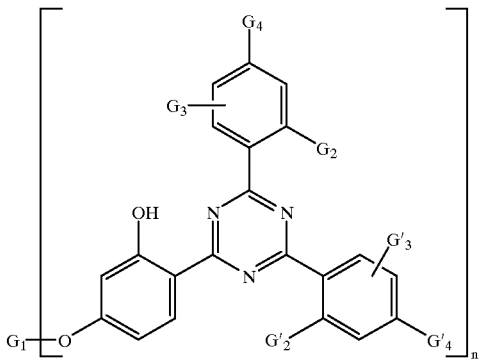

-continued or (AV)

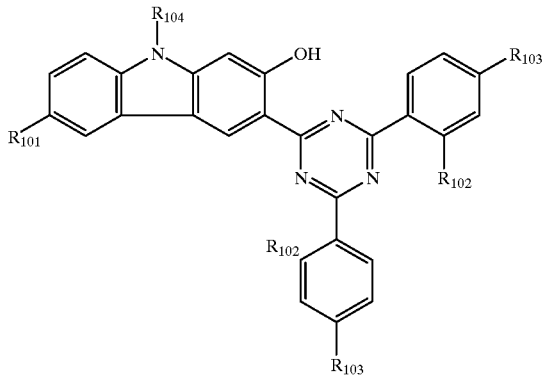

in which, in the formula AIII, n is 1 or 2, and $G_1$, in the case where n=1, is alkyl or alkyl which is interrupted by O or substituted by OH, glycidyloxy, alkenyloxy, COOH, $COOR^e$, or O—CO—$R^f$; or is alkenyl; cycloalkyl; phenylalkyl which is unsubstituted or substituted by OH, Cl or $CH_3$; $COR^g$; $SO_2$—$R^h$ or $CH_2CH(OH)$—$R^j$;

where $R^e$ is alkyl; alkenyl; hydroxyalkyl; alkyl or hydroxyalkyl which is interrupted by O; cycloalkyl; benzyl; alkylphenyl; phenyl; phenylalkyl; furfuryl; or $CH_2CH(OH)$—$R^j$;

$R^f$ and $R^g$, independently of one another, are alkyl, alkenyl or phenyl;

$R^h$ is alkyl, aryl or alkylaryl;

$R^j$ is aralkyl or $CH_2OR^k$;

$R^k$ is cyclohexyl, phenyl, tolyl or benzyl; and $G_1$, in the case where n=2, is alkylene; alkenylene; xylylene; alkylene or hydroxyalkylene each of which is interrupted by O; or hydroxyalkylene;

$G_2$ and $G'_2$, independently of one another, are H, alkyl or OH;

$G_4$ and $G'_4$, independently of one another, are H, alkyl, OH, alkoxy, halogen or in the case where n=1, $OG_1$;

$G_3$ and $G'_3$, independently of one another, are H, alkyl or halogen; and in which, in the formula AV, $R_{101}$ is H, $C_1$–$C_8$alkyl or $C_1$–$C_8$alkoxy;

$R_{102}$ and $R_{103}$, independently of one another, are H, halogen, OH, $C_1$–$C_8$alkyl or $C_1$–$C_8$alkoxy; and $R_{104}$ is H, OH, $C_1$–$C_8$alkyl or $C_1$–$C_8$alkoxy.

14. A process for stabilizing photographic recording material comprising, on a support, a blue-sensitive, a green-sensitive and/or a red-sensitive silver-halide emulsion layer, a protection layer above the sensitive layers, and, if desired, layers between the sensitive layers, which comprises incorporating a UV absorber of the formula (1) or (1a) according to claim 1 into a layer.

* * * * *